US009782649B2

(12) United States Patent
Valle

(10) Patent No.: US 9,782,649 B2
(45) Date of Patent: Oct. 10, 2017

(54) ANTI-BOUNCE BACK PROTECTIVE SAFETY SCREEN APPARATUS, SYSTEMS, AND METHODS

(71) Applicant: John Valle Baseball, Inc., Spencerport, NY (US)

(72) Inventor: John A. Valle, Rochester, NY (US)

(73) Assignee: John Valle Baseball, Inc., Rochester, NY (US)

( * ) Notice: Subject to any disclaimer, the term of this patent is extended or adjusted under 35 U.S.C. 154(b) by 0 days.

(21) Appl. No.: 14/711,448

(22) Filed: May 13, 2015

(65) Prior Publication Data

US 2015/0328517 A1 Nov. 19, 2015

Related U.S. Application Data

(60) Provisional application No. 62/122,408, filed on Oct. 20, 2014, provisional application No. 61/996,873, filed on May 16, 2014.

(51) Int. Cl.

| | |
|---|---|
| ***A63B 69/00*** | (2006.01) |
| ***A63B 71/02*** | (2006.01) |
| *A63B 69/40* | (2006.01) |

(52) U.S. Cl.

CPC ..... *A63B 69/0002* (2013.01); *A63B 71/022* (2013.01); *A63B 69/40* (2013.01); *A63B 2069/0006* (2013.01); *A63B 2069/0008* (2013.01); *A63B 2208/0204* (2013.01)

(58) Field of Classification Search

CPC ... A63B 69/0097; A63B 63/00; A63B 63/004; A63B 69/002; A63B 69/0002; A63B 69/0053; A63B 69/0026; A63B 71/022; A63B 2208/0204; A63B 2069/0008; A63B 2069/0006; A63B 69/40

USPC ..... 473/454–456, 451, 422, 433–435, 446

See application file for complete search history.

(56) References Cited

U.S. PATENT DOCUMENTS

| | | | | | |
|---|---|---|---|---|---|
| 331,756 | A * | 12/1885 | Baker | A63B 63/004 | 473/478 |
| 1,142,184 | A * | 6/1915 | Lawrence | A63B 69/0002 | 473/454 |
| 4,210,326 | A * | 7/1980 | Booth | A63B 63/00 | 473/454 |
| 4,258,924 | A * | 3/1981 | Ketchum | A63B 69/0097 | 473/435 |

(Continued)

FOREIGN PATENT DOCUMENTS

| | | | | |
|---|---|---|---|---|
| DE | 3344955 | A1 * | 6/1985 | A63B 63/00 |

*Primary Examiner* — Mitra Aryanpour

(74) *Attorney, Agent, or Firm* — Randall S. Wayland

(57) ABSTRACT

A protective screen system having a protective screen made up of a protective screen frame and a primary net, and including a protective screen safety apparatus coupled to the protective screen. The protective screen safety apparatus includes one or more spacing connectors adapted to couple a structure such as a protective screen frame, and support and suspend a safety net in front of and spaced from the protective screen frame to minimize bounce back of a ball from the protective screen frame. Methods of protecting a batter with the protective screen safety apparatus are provided. Retrofitting and adjustable protective screen safety apparatus are described, including embodiments adapted to minimize damage to chain-link fences, as are other aspects.

7 Claims, 29 Drawing Sheets

(56) References Cited

U.S. PATENT DOCUMENTS 4,489,941 A * 12/1984 Shieh ..... A63B 71/022 473/454
4,553,751 A * 11/1985 Ketchum ..... A63B 69/0097 473/435
4,863,166 A * 9/1989 Becera ..... A63B 63/00 473/454
5,000,461 A * 3/1991 Borazjani ..... A63B 63/00 473/476
5,205,564 A * 4/1993 Lamberti ..... A63B 63/004 473/421
5,342,063 A * 8/1994 O'Brien ..... A63B 69/0097 473/454
5,511,775 A * 4/1996 Parks ..... A63B 63/00 473/454
5,549,302 A * 8/1996 Lapsker ..... A63B 63/00 473/446
5,888,153 A * 3/1999 Masin ..... A63B 63/00 473/446
6,155,936 A * 12/2000 Dorr ..... A63B 63/00 473/456
6,769,993 B1 * 8/2004 Lasalandra ..... A63B 63/00 473/160
7,074,140 B1 * 7/2006 McNary ..... A63B 69/0053 473/446
7,399,241 B1 * 7/2008 Thomas, Sr. ..... A63B 69/0002 473/422
7,651,416 B2 * 1/2010 Farquhar ..... A63B 63/004 473/446
8,079,923 B2 * 12/2011 Siefker ..... A63B 63/004 473/422
8,246,494 B2 * 8/2012 Stephenson ..... A63B 63/004 473/422
8,651,980 B2 * 2/2014 Jackson ..... A63B 63/00 473/422
8,771,107 B1 * 7/2014 Ayala ..... A63B 69/0002 473/422
8,961,339 B2 * 2/2015 Littman ..... A63B 69/0097 473/422
2005/0288129 A1 * 12/2005 Lewis ..... A63B 69/0002 473/454

* cited by examiner

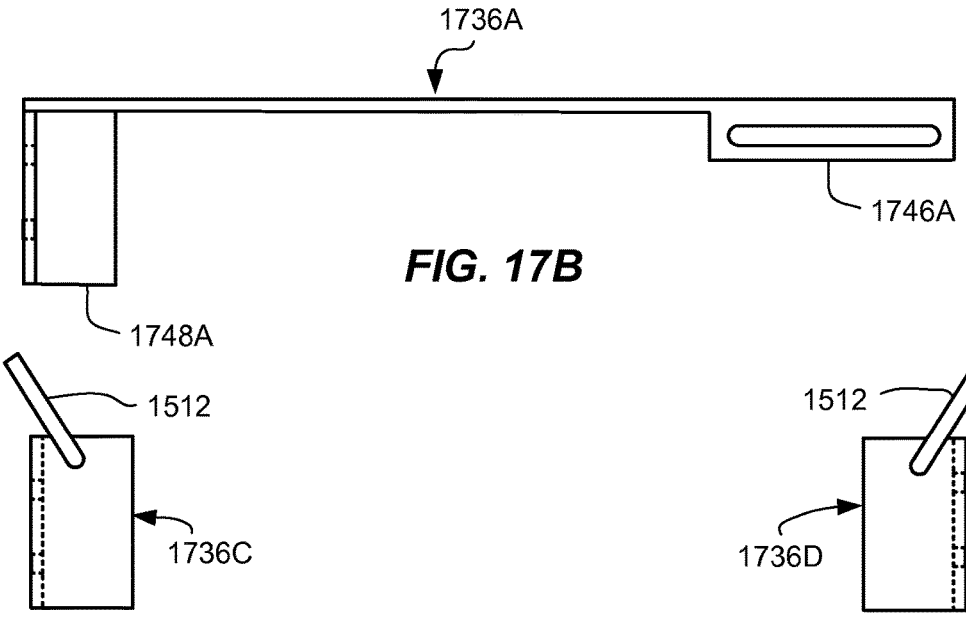
FIG. 17B
FIG. 17D
FIG. 17E
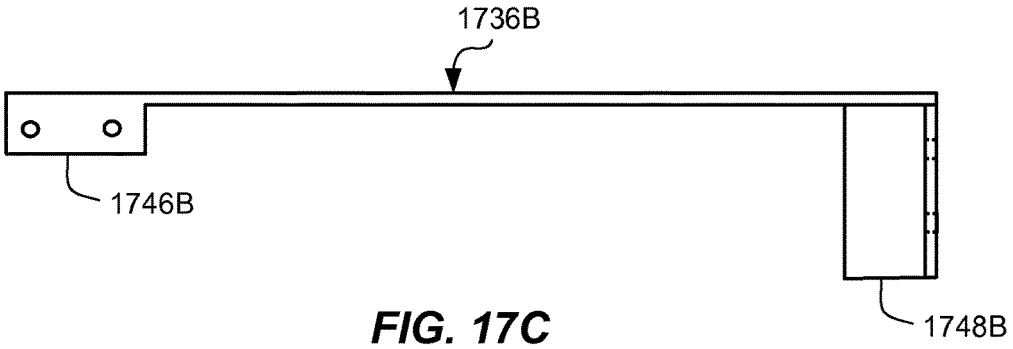
FIG. 17C

ANTI-BOUNCE BACK PROTECTIVE SAFETY SCREEN APPARATUS, SYSTEMS, AND METHODS

RELATED APPLICATIONS

The present invention is related to, and claims priority to, U.S. Provisional Patent Application No. 62/122,408 entitled "Anti-bounce Back Protective Safety Screen Apparatus, Systems, and Methods" filed on Oct. 20, 2014, and to U.S. Provisional Patent Application No. 61/996,873 entitled "Anti-bounce Back Protective Safety Screen Apparatus, Systems, and Methods" filed on May 16, 2014, which are hereby incorporated herein by reference in their entirety for all purposes.

FIELD

The present invention relates generally to protective screens for baseball and/or softball.

BACKGROUND

Conventional protective screens have a bent rigid metal protective screen frame upon which a primary net (e.g., woven nylon net) is received. However, existing protective screens have certain problems. Accordingly, improved protective screens are desired.

SUMMARY

In a first aspect, a protective screen system is provided. The protective screen system includes a protective screen including a protective screen frame and a primary net, and a protective screen safety apparatus coupled to the protective screen, the protective screen safety apparatus including one or more spacing connectors adapted to couple the protective screen safety apparatus to the protective screen frame, and a safety net supported and suspended in front of the protective screen frame by the one or more spacing connectors.

In yet another aspect, a protective screen safety apparatus is provided. The protective screen safety apparatus includes one or more spacing connectors configured and adapted to be coupled to a protective screen wherein the protective screen includes an protective screen frame and a primary net, and a safety net supportable by the one or more spacing connectors and configured to be positioned adjacent to and in front of the protective screen but spaced therefrom, the safety net configured and adapted to prevent bounce back of balls from the protective screen frame of the protective screen In yet another aspect, a method of protecting a batter is provided. The method includes providing a protective screen including a protective screen frame and a primary net, providing a protective screen safety apparatus coupled to the protective screen, the protective screen safety apparatus including a safety net positioned in front of the protective screen frame and spaced therefrom, and preventing bounce back of a ball from the protective screen frame with the safety net.

In yet another aspect, a protective screen safety apparatus is provided. Protective screen safety apparatus includes a support frame adapted to be connectable to a chain-link fence, one or more spacing connectors coupled to the support frame, and a safety net supportable by the one or more spacing connectors and configured to be positioned adjacent to the chain-link fence but spaced therefrom, the safety net configured and adapted to prevent damaging contact of a ball with the chain-link fence.

In yet another aspect, a protective screen safety apparatus is provided. Protective screen safety apparatus includes a support frame, spacing connectors coupled to the support frame, and a safety net adapted to be supported by the spacing connectors and configured to be positioned adjacent to the support frame, but spaced laterally therefrom.

In yet another aspect, a protective screen safety apparatus is provided. Protective screen safety apparatus includes a support frame including connection features configured and adapted to be connected to a structure selected from a group consisting of a protective screen and a chain-link fence, one or more spacing connectors comprising a spring member coupled to the support frame, and a safety net supportable by the one or more spacing connectors and configured to be positioned adjacent to, and in front of the support frame, but spaced therefrom, the safety net configured and adapted to prevent ball bounce back or damaging contact with the structure.

Numerous other aspects are provided in accordance with these and other embodiments of the invention. Other features and aspects of embodiments of the present invention will become more fully apparent from the following detailed description, the appended claims, and the accompanying drawings.

BRIEF DESCRIPTION OF THE DRAWINGS

FIGS. 17B-17E illustrates front views of frame pieces of a protective screen safety apparatus according to one or more embodiments.

DESCRIPTION

Figure 1:
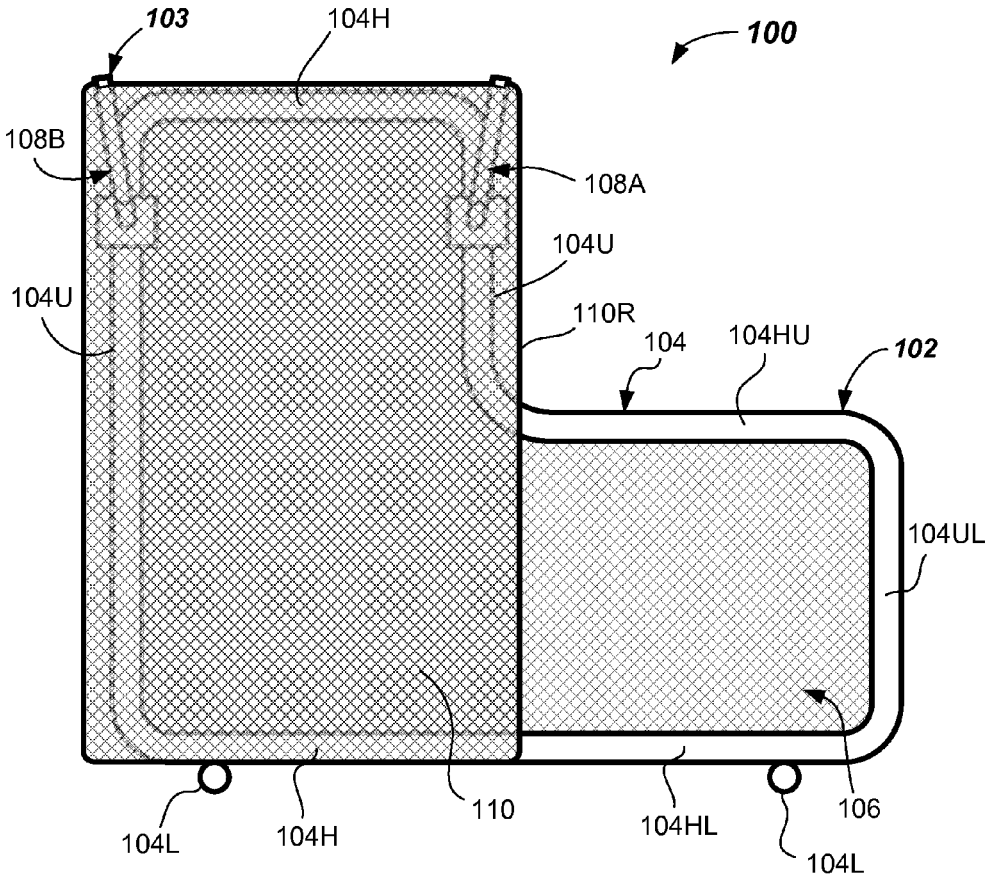
FIG. 1 illustrates a front plan view of a protective screen system including a protective screen safety apparatus according to embodiments.

In baseball or softball batting practice, it is desirable in some cases to live pitch to a batter. A protective screen 102, such as a conventional L-screen or a box screen, may be used to protect the person throwing batting practice (hereinafter "BP"). In particular, during BP, sometimes the batter is placed in very close proximity to the person throwing BP. The ball may be hit at very high velocity back at the person throwing BP. This is especially the case when the batter is advanced. Such drills are considered by many at all levels to help develop fast hands and proper batting fundamentals.

Because protective screen frames 104 of protective screens 102 of the conventional type are made to withstand balls (e.g., baseballs and softballs) being hit at a high velocity so as to avoid denting, bending, breaking, the protective screen frame 104 is generally made of a strong material, such as aluminum or steel, or other suitably rigid material. Because of this, when a ball is pitched, or tossed to the batter, and the batted ball returns and makes direct contact with the protective screen frame 104 (e.g., an upright frame post or other portion of the protective screen frame 104), it becomes a potentially dangerous situation because the baseball or softball can ricochet directly back at the batter. Of course, if struck, this may cause injury to the face, hands, or other body parts of the batter. Some users of a protective screen 102 will place padding on the protective screen frame 104 to help extend the life of the protective screen frame 104. This may lessen the impact of the ricocheting slightly, and may lessen the ricochet speed of the ball to an extent, but it still may not be enough to avoid injury the batter.

In some instances, especially with powerful hitters, and/or when the batter is positioned in very close proximity to the protective screen 102, the speed of the ball may be so high as it ricochets off the protective screen frame 104, that it may be difficult, if not impossible, for a batter to react quickly enough to in order to avoid being hit thereby. This is especially true, because the batter may be still in the process of finishing their swing that had struck the ball in the first place. Thus, the inventor herein has recognized that protection against ball ricochet is very much desired.

A first embodiment of the invention described herein provides protection to the batter against such ball ricochet.

Another very common usage of a protective screen 102 is to throw automated BP (i.e., with a pitching machine). Typically, the pitching machine is placed behind the protective screen 102 and is hand fed by a person, and thus the person and the machine are located behind the protective screen 102. In the case of an L-screen, the person is situated behind the higher portion of the protective screen 102 and the pitching machine may be behind the lower portion. In this way, the ball may be pitched without the primary netting being in the way of the ball being pitched. In this instance, a potentially dangerous scenario may occur when the ball is struck by the batter and it is returned directly at the pitching machine. For instance, the ball can ricochet off the pitching machine and strike the person who is feeding the pitching machine with the ball.

Because there is not a line of protection between the pitching machine and the person, there is nothing to protect them from the ball ricocheting off the pitching machine directly at them. Generally, a person (e.g., player/coach) when performing this task, will wear a helmet, but that does not protect the face, throat, ears, hands or the rest of the body. Physical injury can potentially occur. Thus, in accordance with another aspect, a method and apparatus are provided that additionally protects a person throwing automated BP.

In another problem area, it may be difficult to determine when the primary net becomes too weak to handle a hard struck ball due to continued use. Upon primary net failure, the ball may go through the primary net, because of its weakened state, and may strike the person throwing BP. Many times, the owner of the protective screen, such as at a workout facility will put on a double primary net to double the strength of the netting for protection and lengthen the time between net replacements. These two primary netting layers are directly adjacent to each other, not spaced. Thus, although they offer better protection than one, they do not address the ricochet problem discussed herein.

As such, in one embodiment, it is desirable to protect the batter from ricochet of the ball off from the protective screen frame of the protective screen, and in another embodiment, it is desirable to additionally protect the person throwing BP from net breakage.

In another area of applicability of the invention, many times when a baseball or softball team is practicing or preparing for a game, they will hit balls into the chain-link fences surrounding the field. Of course, this practice is prohibited at many fields because over time, it may cause unsightly bulges the chain-link fence.

To address these problems, according to one or more embodiments, improved protective screen systems, apparatus, and methods are provided. In one embodiment, a protective screen safety apparatus adapted for coupling to the protective screen frame is provided. Some embodiments of the invention are directed at providing a protective screen safety apparatus that may be retrofitted to an existing protective screen (e.g., to an existing L-screen). The protective screen safety apparatus, in one embodiment, suspends a safety net in front of, and spaced a desired distance from, the protective screen frame, in order to absorb the high speed impact of the ball, so to avoid the ball being able to ricochet off the protective screen frame or to lessen substantially the ball ricochet speed.

The protective screen safety apparatus, in one or more embodiments, may suspend the safety net by the use of spacing connectors that couple to the protective safety frame. The safety net may be replaced with a new one when it wears out thereby further protecting the person throwing BP.

In another embodiment, the safety net can be attached to both the support legs of the protective screen, and may also be secured to a top part of the protective screen so that the safety net is suspended in front of the primary net. Some embodiments may cause a hard struck ball be deflected upward or in a direction that will not be at the batter.

In another embodiment of the protective screen safety apparatus, a safety net can also be hung and suspended on the pitcher side of the protective screen (opposite the batter). For example, when a person is feeding a pitching machine, a safety net may be placed in the appropriate location between the person feeding the pitching machine and the pitching machine itself. Thus, if the struck ball hits the pitching machine and ricochets in a direction towards the person feeding the pitching machine, the safety net becomes a barrier between the pitching machine and person, thus keeping the ball from being able to directly hit the person feeding the pitching machine, or at least may slow down the velocity of the ricochet so as not to cause serious injury.

As described above, sometimes, and albeit the facility owners object to this practice, a batter may perform soft toss or hit from tees into chain-link fences at ball fields, which over time damages the fence, causing it to bulge. In another embodiment, a protective screen safety apparatus is provided that includes a frame that is configured to be hung on, and provide protection for, the chain-link fence.

These and other embodiments of protective screen systems, protective screen safety apparatus, and methods of protecting a person throwing BP and/or a batter or a chain-link fence are described below with reference to FIGS. 1-17F. The drawings are not necessarily drawn to scale. Like reference numerals are used throughout the specification to denote like elements.

Figure 2:
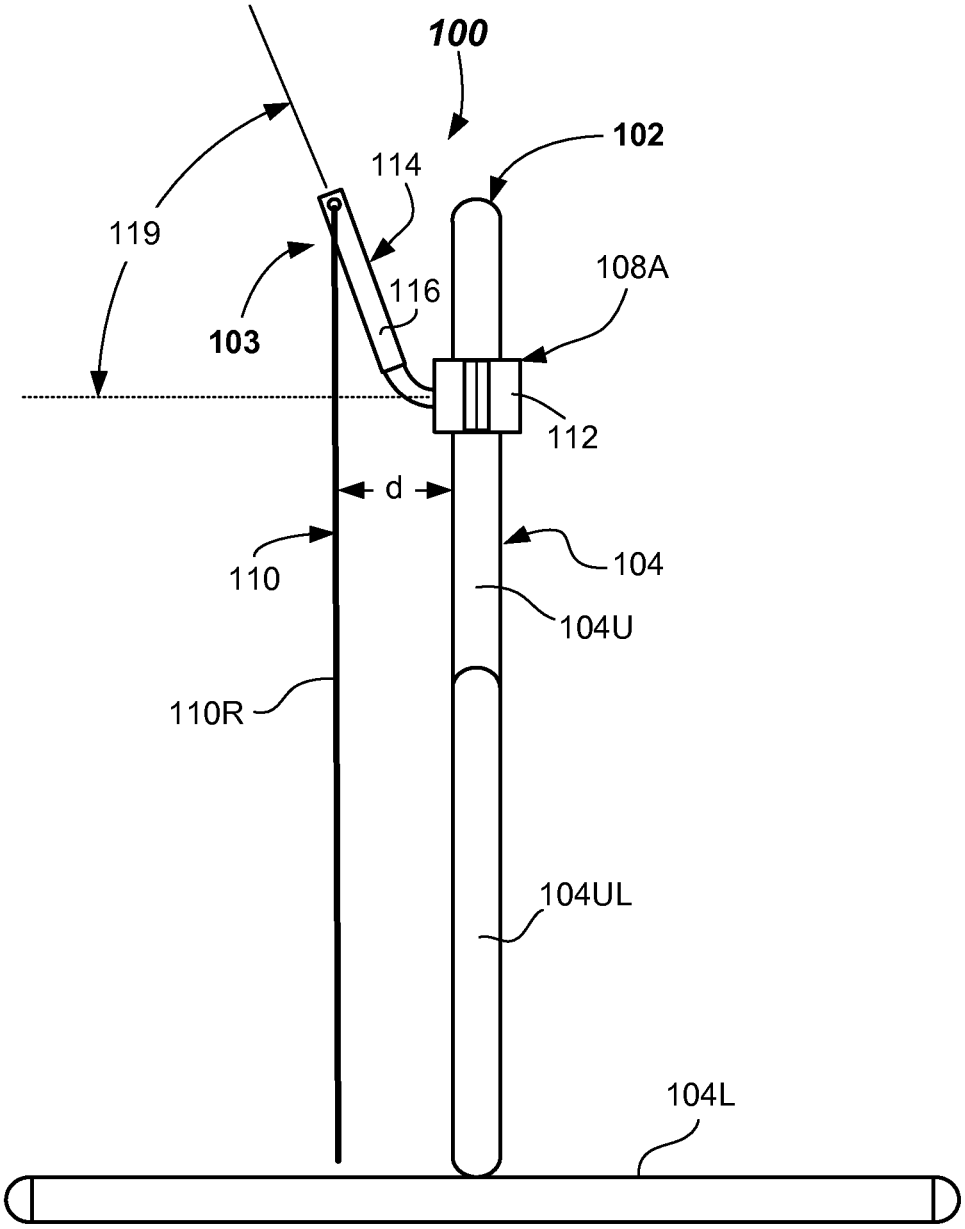
FIG. 2 illustrates side plan view of a protective screen system including a protective screen safety apparatus according to embodiments.

Referring now in specific detail to FIGS. 1 and 2, a protective screen system 100 is provided, which illustrates a first embodiment that may be useful to better protect a person throwing BP. In addition, the protective screen system 100 may prevent a batter from being hit by rebounding (e.g., bounce back) or ricochet of balls (e.g., baseballs or softballs).

Protective screen system 100 includes a protective screen 102 and a protective screen safety apparatus 103 operable therewith according to embodiments of the present invention.

Protective screen 102 may be conventional, and may include a protective screen frame 104 and a primary net 106 fastened to or received over (e.g., like a sock) the protective screen frame 104. Protective screen frame 104 may be made from multiple types of rigid tubing, such as aluminum, steel, or the like. The diameters, shapes, or overall dimensions of the frame tubing may be sufficiently strong to prevent denting or damage when struck by a ball. Protective screen frame 104 may be about 1 inch to about 2.5 inch diameter steel tube, for example. Other frame shapes and types may be used. For example, an L-screen shape of the protective screen frame 104 is shown including main uprights 104U and main horizontals 104H, which generally outline a main location behind which the person throwing BP will be located and lower portion upright 104UL and upper and lower portion horizontals 104HU, 104HL, which generally define the lower portion. Protective screen frame 104 may also include stabilizing supports 104L (e.g., legs). However, it should be recognized that embodiments of the invention described herein will work equally well with other frame shapes, such as rectangular box frames, and the like.

Primary net 106 may be supported by the protective screen frame 104. Primary net 106 may be single layer net that is fastened (e.g., laced) to the perimeter of the protective screen frame 104 by fasteners, or often times has double netting in the form of a pillow case design so it can be easily placed/slipped on the protective screen frame 104 by slipping the primary net 106 over the protective screen frame 104 like a sock in a non-spaced relationship.

The primary net 106 may be made of different strengths of knotted twine (e.g., Nylon, Polypropylene, or the like), which some common ones are #36 or #42, but can be much stronger, such as #96. The higher the number the stronger the netting is against the possibility of a ball piercing through. In addition, a protective screen 102 may include padding (not shown) on some or all of the protective screen frame 104 that may extend the life of the protective screen frame 104 as it is subjected to multiple ball strikes at high speed.

In accordance with one or more embodiments, the protective screen safety apparatus 103 is coupled (e.g., secured or fastened) to the protective screen 102. Protective screen safety apparatus 103 may be retrofitted to the protective screen 102 in some embodiments. Protective screen safety apparatus 103 includes one or more spacing connectors 108A, 108B that may be configured and adapted to couple (e.g., are coupleable) to the protective screen frame 104, and a safety net 110 that is supported and suspended a distance "d" in front of the primary net 106 and protective screen frame 104 by the one or more spacing connectors 108A, 108B.

The safety net 110 may be suspended in front of at least some of the main uprights 104U and/or main horizontals 104H of the protective screen frame 104 by the one or more spacing connectors 108A, 108B. Two spacing connectors 108A, 108B are shown in the depicted embodiment. However, other numbers of spacing connectors may be used. In the depicted embodiment, the safety net 110 is suspended in front of both main uprights 104U and both main horizontals 104H, as these are the most likely culprits that would cause bounce back towards the batter. The safety net 110 may be made of the same material as the primary net, and may include a reinforcing edge 110R in some embodiments. Reinforcing edge 110R may be a rope border threaded through edge of the netting, a sewn material such as a sewn (e.g. Vinyl) enveloping edge, or the like. If sewn edge, corner grommets may be used to fasten the safety net 110 to the spacing connectors 108A, 108B. Safety net 110 may be made of different strengths of knotted twine (e.g., Nylon, Polypropylene, or the like), which may be square mesh, diamond mesh, or other suitable mesh shapes. Safety net 110 may be #36 or #42, but can be much stronger such as #84 or #96. Safety net 110 may include mesh size small enough to prevent a ball from entering, such as ½ inch, ½ inch, ¾ inch, 1 inch, 1½ inch, 2 inch, or larger.

In the depicted embodiment, two spacing connectors 108A, 108B are used to suspend the safety net 110. One spacing connector 108A, 108B may be attached to each main upright 104U of the protective screen frame 104, for example. The one or more spacing connectors 108A, 108B may be designed to support and suspend the safety net 110 so that the safety net 110 hangs in spaced relationship to the front of at least a portion of the primary net 106 and the protective screen frame 104, such as at least the main portion of the protective screen frame 104. The safety net 110 may hang (e.g., vertically in the depicted embodiment) and may be spaced in front of the protective screen frame 104 by a suitable distance "d". In one or more embodiments, the safety net 110 may be spaced a distance "d" of about 3 inches or more (e.g., between about 3 inch to about 20 inches, or even between about 8" and 18" inch in other embodiments) in front of the main uprights 104U of the protective screen frame 104, so that the safety net 110 can substantially absorb the impact of a ball prior to the ball hitting the primary net 106, or substantially absorb the ball's kinetic energy before hitting the protective screen frame 104. In a box-screen frame, the safety net 110 may also be spaced a distance "d" in front of the main uprights thereof.

In some instances, the safety net 110 may keep the ball from hitting the primary net 106 or protective screen frame 104 at all. This protects the person throwing BP and also the batter by minimizing or preventing any ricochet of the ball hitting the protective screen frame 104 and getting redirected directly back to the batter. With a conventional protective screen 102, the ricochet may be at such a speed that it would be difficult, if not impossible, to avoid getting hit by the returning ball, as discussed above. Thus, injuries may be avoided by the use of the protective screen system 100 including the protective screen safety apparatus 103.

As shown in more detail in FIG. 4, at least some of the one or more spacing connectors 108A, 108B may comprise an adapter 112 configured and adapted to couple to the protective screen frame 104, and an extending attachment 114 to which the safety net 110 is suspended, such as at an end thereof. In the depicted embodiment, at least a portion of the one or more spacing connectors 108A, 108B is flexible. The flexibility may be provided by a spring member 116 which may comprise part or all of the extending attachment 114. In this manner, portions of the one or more spacing connectors 108A, 108B are configured and operable to flex upon being struck by a ball. The spring member 116 may be any suitable spring, such as a coil spring, a cast or molded elastomer or plastic spring, a leaf spring, flat bar spring, a flexible rod such as a fiberglass, composite, spring steel, or other material rod, torsion spring, combinations of the foregoing, or the like. Other suitable spring member configurations may be used. Spring member 116 may have a vertical spring rate, when pulling vertically downward at the end of the spring member 116 at the point of connection of the safety net 110, of between about 0.5 lb/in and about 5 lb/in, and between about 1 lb/in and about 3 lb/in in some embodiments. Other suitable vertical spring rates may be used.

Figure 5A:
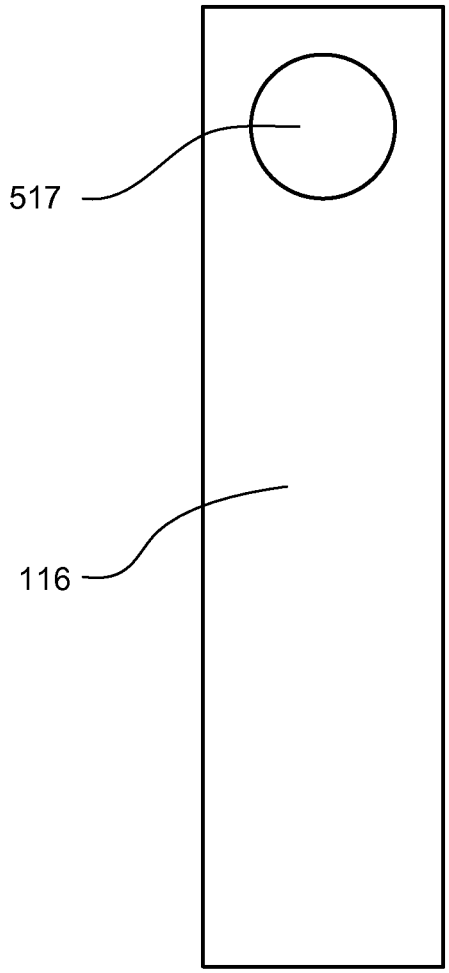
FIGS. 5A and 5B illustrate side and end views, respectively, of an elastomer spring member of a protective screen safety apparatus according to embodiments.
Figure 5B:
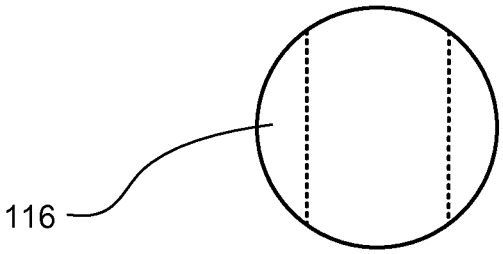

In one or more embodiments, the spring member 116 may be as depicted in FIGS. 5A-5B. Spring member 116 may be made of an elastomer material, such as a slightly damped elastomer. The elastomer may be rubber, silicone, urethane, or the like. In some embodiments, the material may be a cast urethane and may be colored. Other suitable elastomer materials may be used. The spring member 116 may include a rod or other suitable shape and a through bore 517 or other connection feature adapted to receive or secure the safety net 110 to the spring member 116. Safety net 110 may be tied to the through bore 517 or a peripheral rope around the perimeter of the safety net 110 may extend through the through bore 517. Other suitable connections may be made.

Figure 3:
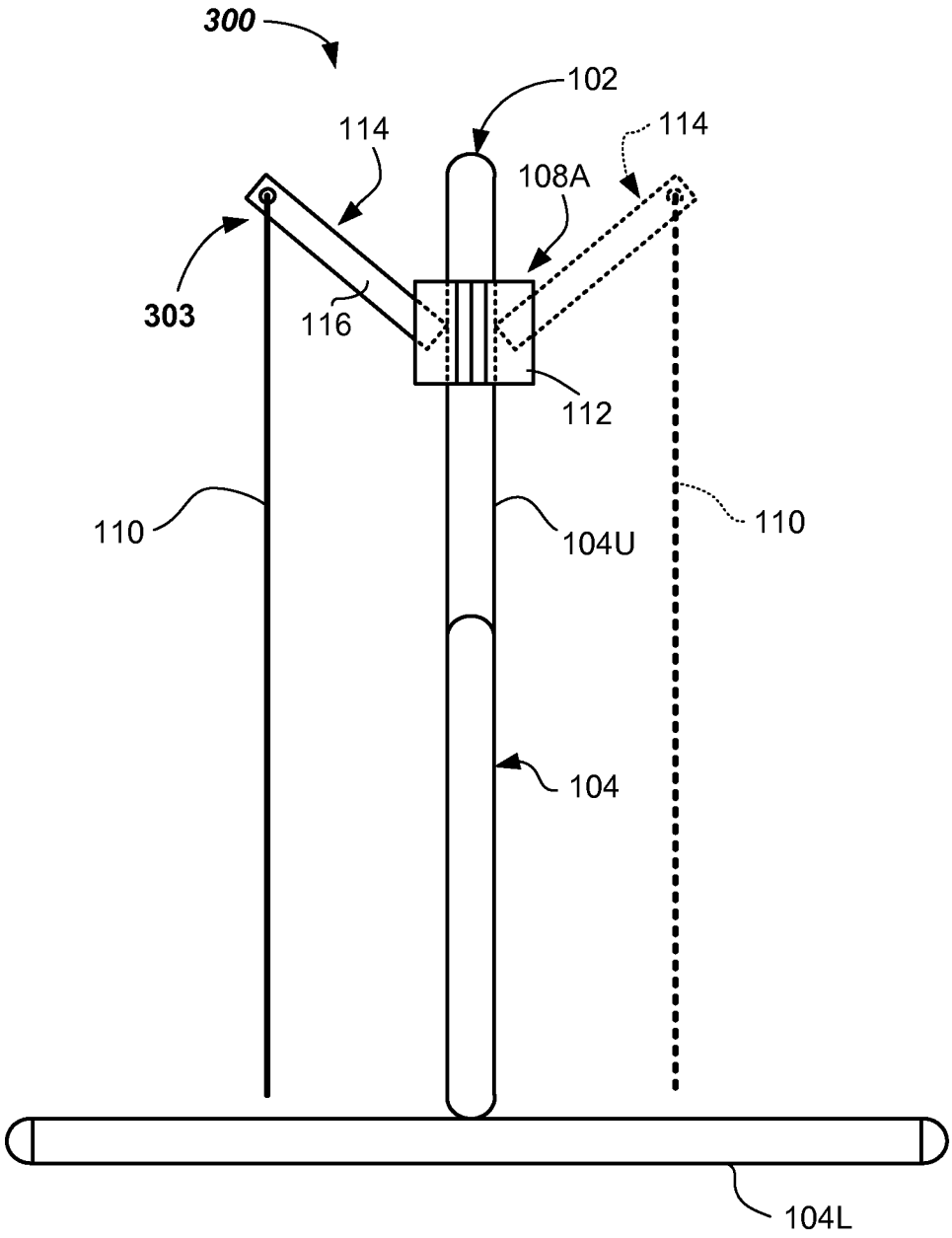
FIG. 3 illustrates side plan view of an alternate protective screen system including a protective screen safety apparatus wherein the protective screen safety apparatus may be reconfigurable between sides according to embodiments.

FIG. 3 illustrates another embodiment of the protective screen system 300. In this embodiment, the protective screen safety apparatus 303 is reconfigurable. For example, the safety net 110 may be moved from one side of the protective screen frame 104 to another by removing the extending attachments 114 and reinserting them in recesses 118B (FIG. 4B) of the adapters 112 on the other side. Because the protective screen 102, at times, will need to be turned approximately 180 degrees to accommodate a person throwing BP that may be a lefty thrower or a righty thrower, the protective screen safety apparatus 303 may be able to be readily removed from one side of the protective screen 102, and placed on the other side of the protective screen 102.

Figure 4A:
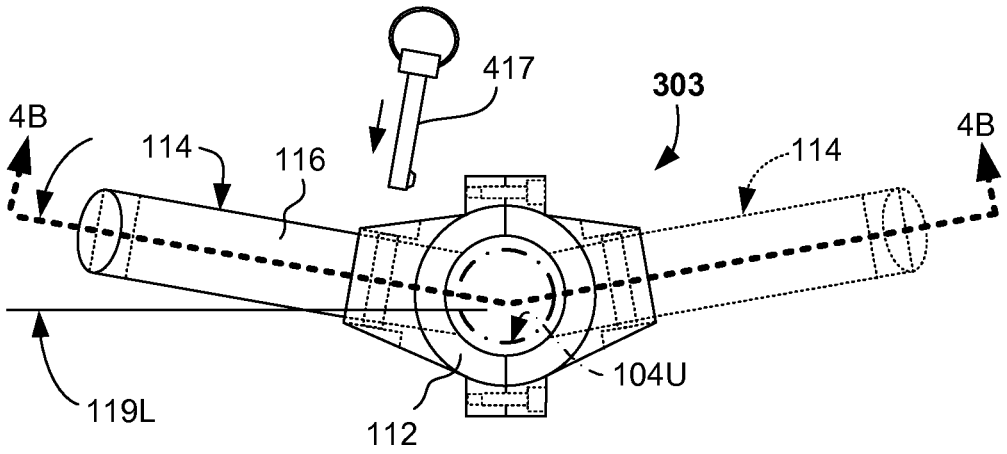
FIG. 4A illustrates a top plan view of a portion of a protective screen system including a reconfigurable protective screen safety apparatus according to embodiments.
Figure 4B:
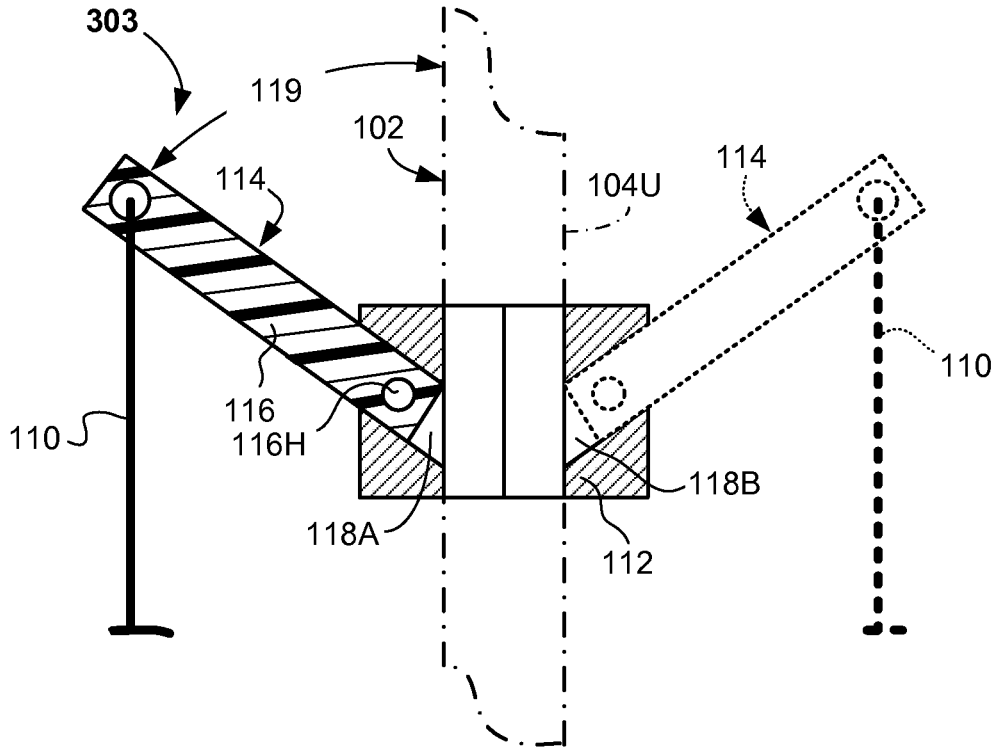
FIG. 4B illustrates a cross-sectioned side view of a protective screen safety apparatus according to embodiments.

To accommodate this, as shown in FIGS. 4A-4B, the extending attachment 114 of the spacing connectors 108A, 108B, (which may be identical to each other) and which may include a spring member 116 that suspends the safety net 110, fits into a first recess 118A formed in the adapter 112. Thus, adapter 112 may remain coupled to the main upright 104U (shown dotted) of the protective screen frame 104 as the safety net 110 is moved to the other side. The spring member 116 can be removed from the first recess 118A and easily attached to a second recess 118B on the other side of the protective screen 102 (see dotted outline). Thus, the protective screen safety apparatus 303 is now securely suspended on the reverse side of the protective screen 102. The first recess 118A and second recess 118B in the adapter 112 may have a securement 417 such as securing pin, set screw, bolt, snap fit feature, or the like that will secure the extending attachment 114 to the adapter 112. In the depicted embodiment, the securement 417 may be a removable member that may be received through a hole 116H in the spring member 116.

FIGS. 4A and 4B illustrate the details of a protective screen safety apparatus 303. Each spacing connector 108A, 108B couple directly to the protective screen frame 104, and includes an adapter 112 that may have two pieces that fit around, and couple to, the protective screen frame 104, such as to the main uprights 104U, lower portion upright 104UL, or the lower portion horizontal 104HU, for example. Clamping can be accomplished by any suitable fastener, such as bolts, wing nuts, quick disconnects, or the like. Thus, the safety net 110 may be suspended from the protective screen frame 104 without being jarred loose, and may be retrofitted to an existing protective screen 102 and provide the benefits as described herein.

As shown in FIGS. 2 and 4B, the first recess 118A and the second recess 118B of the adapters 112 of the spacing connectors 108A, 108B may oriented such that the extending attachments 114 project off the protective screen frame 104 at an upward angle 119 (e.g., an upward angle as shown measured from the horizontal). The upward angle 119 to the vertical may be between about 10 degrees and about 80 degrees, between about 10 degrees and 60 degrees, between about 20 degrees and 50 degrees, and about 35 degrees in some embodiments. An axis of the first recess 118A and second recess 118B may also be slightly offset from the main uprights 104U in a lateral direction by a lateral offset angle 119L (see FIG. 4A) so that the safety net 110 will hang slightly wider than the main portion of the protective screen frame 104. This helps cover portions of the protective screen frame 104 and improve the chances that a struck ball cannot directly hit the protected portion of the protective screen frame 104. Lateral offset angle 119L may be between about 10 degrees and 60 degrees, or even between about 10 degrees and 50 degrees, or even between about 20 degrees and 40 degrees, and about 30 degrees in some embodiments.

In the depicted embodiment, the extending attachment 114 is a spring member 116 including flexibility. The extending attachment 114 may be one-piece part made of an elastomer material, similar to that described in FIG. 5A-5B that has the sufficient flexibility to handle the impact of a ball hitting it or the safety net 110 that it is suspending. Other constructions of the spring member 116 may be used.

Figure 4C:
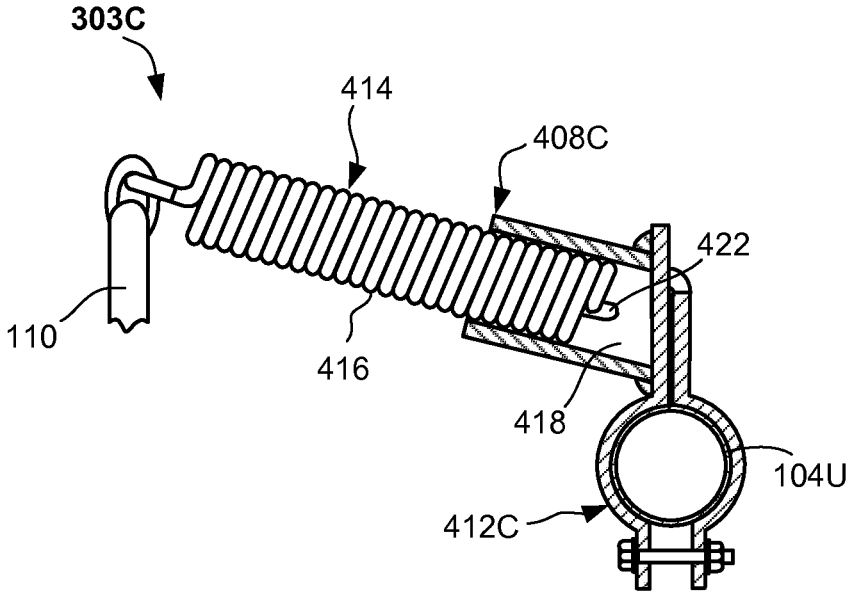
FIG. 4C illustrates a side plan view of a protective screen safety apparatus according to embodiments.
Figure 4D:
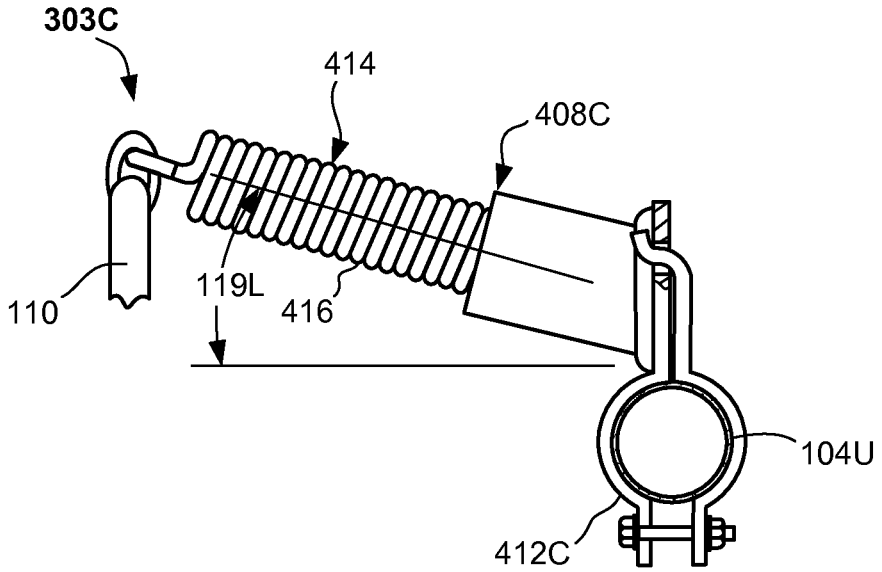
FIG. 4D illustrates a side plan view of a reconfigurable protective screen safety apparatus according to embodiments.

FIGS. 4C and 4D illustrate the details of another protective screen safety apparatus 303C. The spacing connector 408C couples directly to the protective screen frame 104, and includes an adapter 412C that has two pieces that fit around and couple to the protective screen frame 104, such as to the main uprights 104U. Optionally, the adapter 412C may attach to lower portion upright 104UL, or the lower portion horizontal 104HU, for example. Clamping can be accomplished by a fastener, such as bolts, wing nuts, quick disconnects, or other types of suitable fasteners. Thus, the safety net 110 (a portion shown) may be suspended from the protective screen frame 104 without being jarred loose, and may be retrofitted to an existing protective screen 102.

A recess 418 of the adapter 412C of the spacing connectors 408, may oriented such that the extending attachments 414 project off the protective screen frame 104 at an angle; which may include the upward angle 119 (like shown in FIG. 2) and/or a lateral offset angle 119L, as shown.

In the depicted embodiment, the extending attachment 414 is a spring member 416 comprising a coil spring. The safety net 110 may be attached on one end of the coil spring such as to a hook formed on that end, and the other end may be received in the recess 418. A bent over end of the coil spring may be received in a slot 422 formed in the adapter 412C to prevent rotation of the spring member 416 in the recess 418.

Figure 6A:
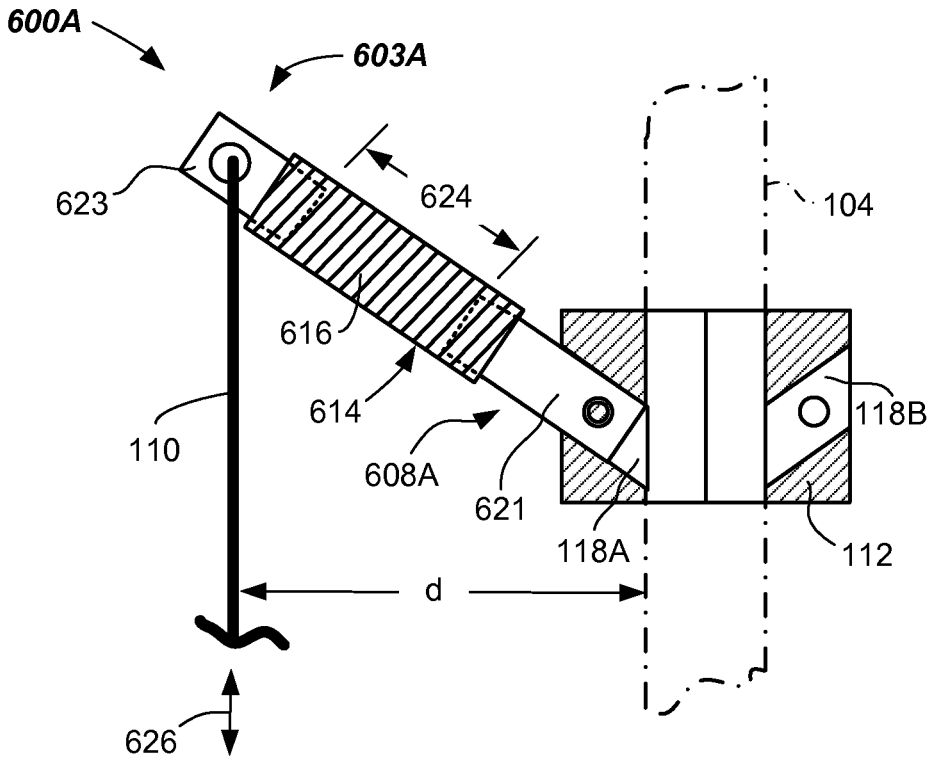
FIG. 6A illustrates a side view of another protective screen safety apparatus according to embodiments.

FIG. 6A illustrates another embodiment of the protective screen safety system 600A. In this embodiment, the one or more spacing connectors 608A of the protective screen safety apparatus 603A include an extending attachment 614 made of multiple pieces. The protective screen safety apparatus 603 may also be reconfigurable. FIG. 6A shows the protective screen safety apparatus 603A consisting of multiple parts, with one of the parts being a spring member 616 that is attached to a lower member 621 on one end. Lower member 621 may be a rod or tube and is inserted into the first recess 118A in the adapter 112. Adapter 112 may be as previously described. As before described, the extending attachment 614 may be secured to the adapter 112 by any suitable retaining feature such as a bolt, pin or the like (not shown). Adapter 112 may be a two-piece adapter that clamps to the protective screen frame 104 at any suitable location. An upper member 623 on another end may be attached to, and protrude from, the spring member 616. The safety net 110 may be connected to, and suspended from, the upper member 623. As previously described, the adapter 112 may include a first recess 118A and second recess 118B on another side. In this way, the safety net 110 and extending attachments 614 of the protective screen safety apparatus 603A may be reconfigured from one side to the other.

The spring member 616 in this embodiment may be a coil spring. Lower member 621 and upper member 623 may be press fit or snug fit into the ends of the spring member 616 (e.g., coil spring). The coil spring may have a 1.563 inch outer diameter with a 0.207 inch diameter coil diameter, an inner diameter of about 1.149 inch and active length 624 of about 13 inches. Active length 624 is the length that may flex, and that is not constrained by a connecting member, such as by lower member 621 and upper member 623. The spring rate in the vertical direction 626 of the spring member 616 may be about 2 lb/inch. Other spring rates may be used. These specifications may be used for other coil springs described in other embodiments herein.

Figure 6B:
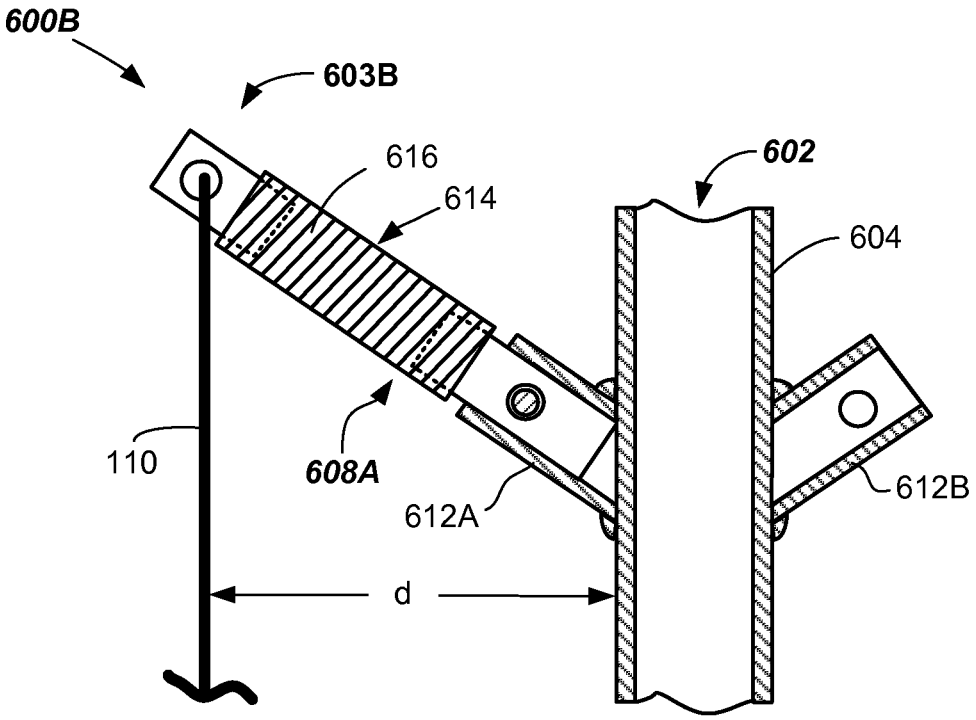
FIG. 6B illustrates a side view of yet another protective screen safety apparatus according to embodiments.

FIG. 6B illustrates another embodiment of the protective screen safety system 600B. In this embodiment, the one or more spacing connectors 608A of the protective screen safety apparatus 603B are the same as described in FIG. 6A. However, in this embodiment, the first adapter 612A may be coupled to the protective screen frame 604 by welding. Any suitable retaining feature, such as a pin, bolt, or the like may be used to secure the extending attachment 614 to the first adapter 612A. As before, the safety net 110 may be connected to, and suspended from, the extending attachment 614 including the spring member 616 so that the safety net 110 is spaced a lateral distance "d" (as described herein) from the upright portion of the protective screen frame 604. Similarly, the safety net 110 and extending attachment 614 of the protective screen safety apparatus 603B may be reconfigured from one side to the other by inserting the extending attachments 614 into respective second adapters 612B, which may be welded to the protective screen frame 604, such as on spaced portions sides thereof. The protective screen frame 604 of the protective screen 602 may have the first adapter 612A and second adapter 612B welded thereto, but otherwise may be configured as conventional, such as in an L-screen or box-screen configuration.

Figure 6C:
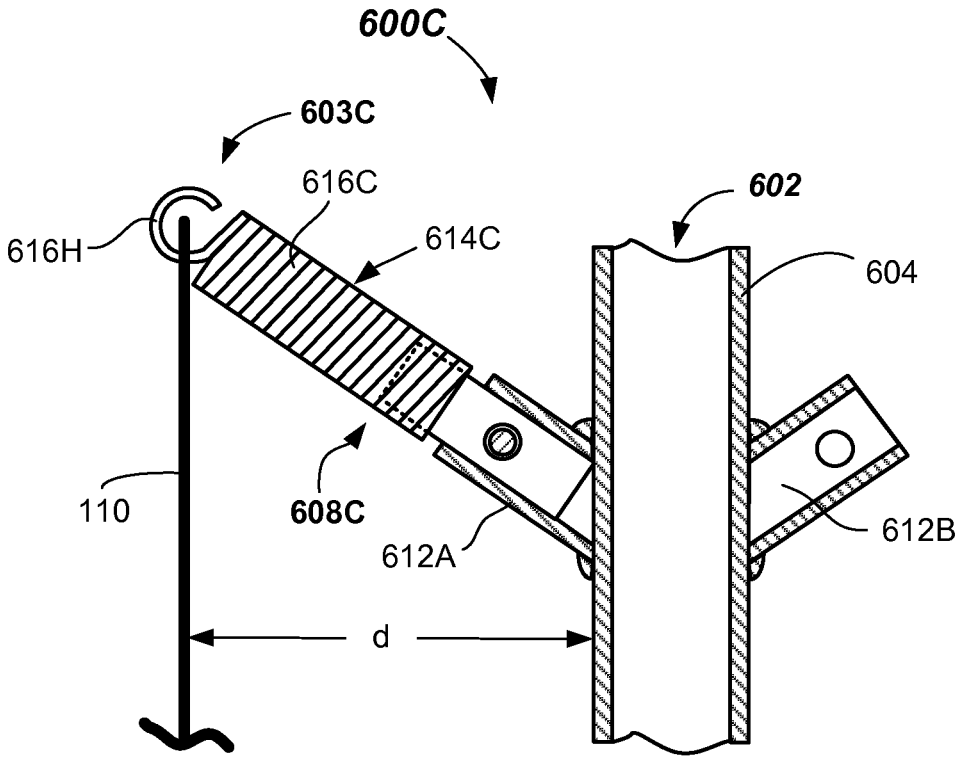
FIG. 6C illustrates a side view of yet another protective screen safety apparatus according to embodiments.

FIG. 6C illustrates yet another embodiment of the protective screen safety system 600C. In this embodiment, the one or more spacing connectors 608C of the protective screen safety apparatus 603C are the same as described in FIG. 6A on the lower end. However, in this embodiment, the upper end of the extending attachment 614C is a hook 616H formed on the spring member 616C. The safety net 110 may be secured to the hook 616H. As before, any suitable retaining feature, such as a pin, bolt, or the like may be used to secure the extending attachment 614C to the first adapter 612A. As before, the safety net 110 may be connected to, and suspended from, the end of the extending attachments 614C (e.g., from the hooks 616H) so that the safety net 110 is spaced a lateral distance "d" from the upright portion of the protective screen frame 604 of the protective screen 602. Similarly, the safety net 110 and extending attachment 614C of the protective screen safety apparatus 603C may be reconfigured from one side to the other by inserting the extending attachment 614C into a second adapter 612B.

Figure 6D:
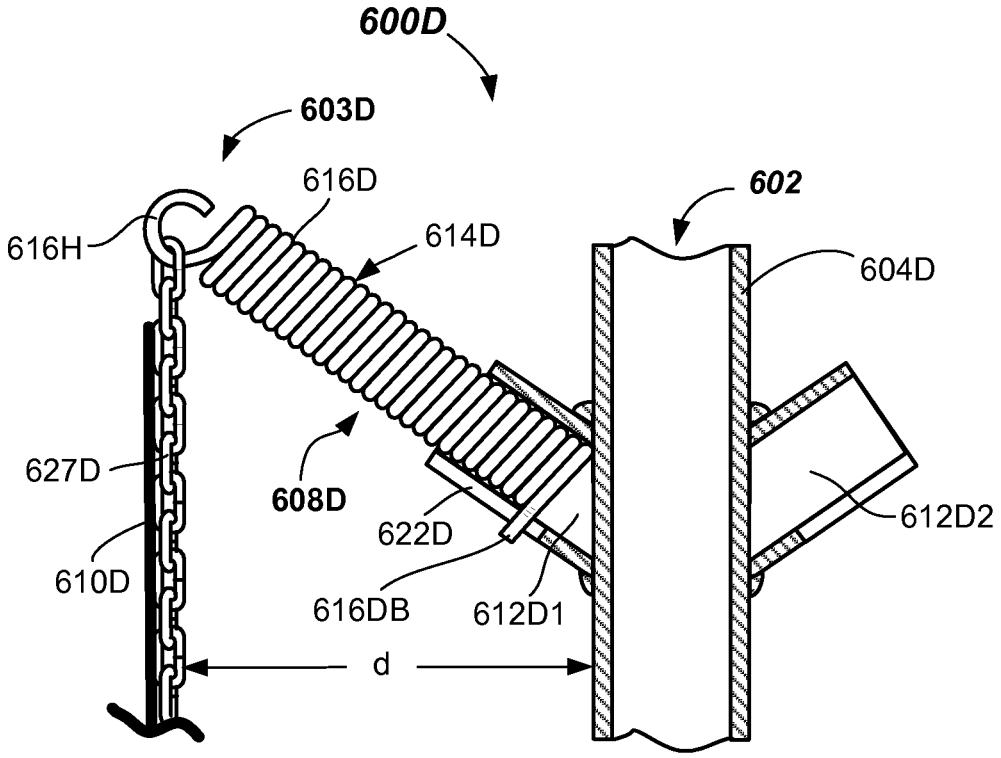
FIG. 6D illustrates a side view of yet another protective screen safety apparatus including added safety screen mass comprising a chain according to embodiments.
Figure 6E:
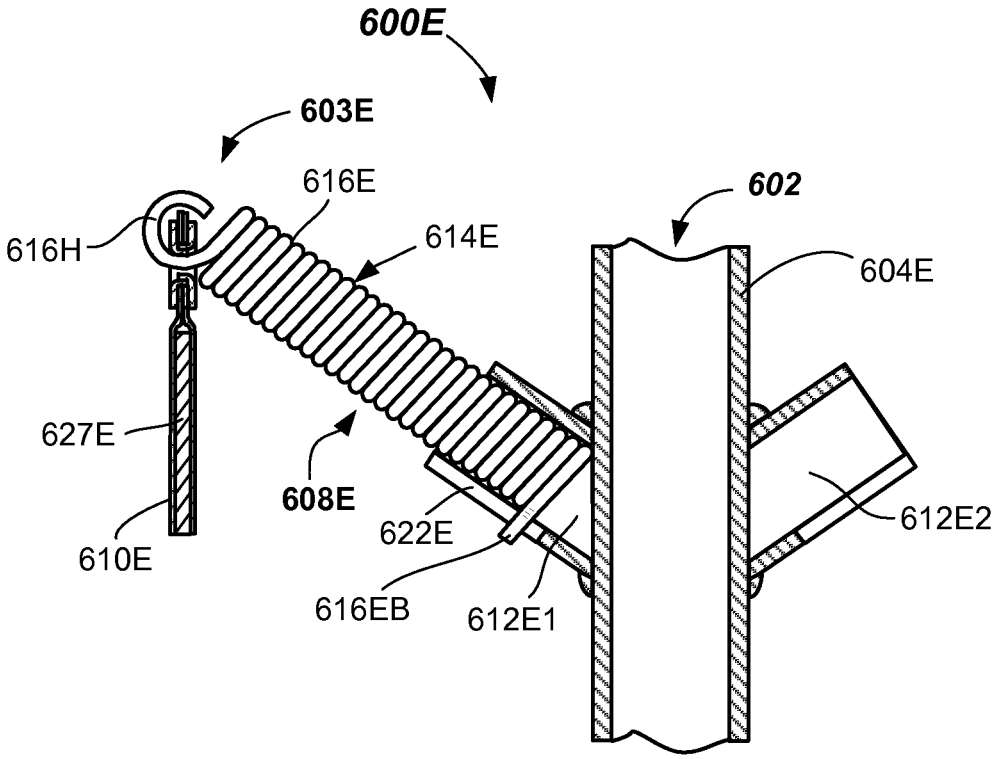
FIG. 6E illustrates a side view of yet another protective screen safety apparatus including added safety screen mass comprising a cable according to embodiments.

FIGS. 6D and 6E illustrate two additional embodiments of protective screen safety system 600D, 600E, respectively. In these embodiments, the one or more spacing connectors 608D, 608E of the protective screen safety apparatus 603D, 603E include a coil spring as the spring member 616D, 616E of the extending attachment 614D, 614E. Similarly, the adapters 612D1, 612D2 and 612D1, 612E1 may be welded to the frame 604D, 604E of the protective screen 602, and may receive a bent-over portion 616DB, 616EB of the spring member 616D, 616E in slots 622D, 622E. The safety net 610D, 610E may be secured to the hooks 616H so that the safety net 610D, 610E may be spaced a lateral distance "d" from the upright portion of the protective screen frame 604D of the protective screen 602. Similarly, the safety net 610D, 610E and extending attachments 614D, 614E of the protective screen safety apparatus 603C may be reconfigured from one side to the other by inserting the extending attachment 614D, 614E into a second adapter 612D2, 612E2.

In the depicted embodiments, the safety nets 610D, 610E may include added mass 627D, 627E. The added mass 627D may be a chain that is fastened to the netting material of the safety net 610D. A link of the chain may be used to secure the safety net 610D to the hook 616H. For example, the added mass 627D may be a welded-link chain having chain links that are between about ½ inch and 3 inch in length. The added mass 627E may optionally be a metal cable fastened along the sides or elsewhere on the safety net 610E. A grommet may be used to secure the safety net 610E to the hooks 616H. Other fastening methods may be used, as well. The added mass 627D, 627E may be fastened to the netting material or the reinforcing border thereof or elsewhere on the new by any suitable means, such as by sewing, clips, wires, sewing into the reinforcing border, or any other means. The added mass 627D, 627E may extend along one or both sides of the netting material and may run from a top of the safety net 610D, 610E to the bottom in some embodiments. Added mass 627D, 627E may be provided along the bottom of the safety net 610D, 610E in some embodiments. Other locations for the added mass may be used. Added mass may be alternatively or additionally concentrated in one or a number of spaced locations on the safety net, as weights, in some embodiments. The added mass may serve to absorb kinetic energy allowing the safety net to be positioned closer to the screen frame.

Figure 6F:
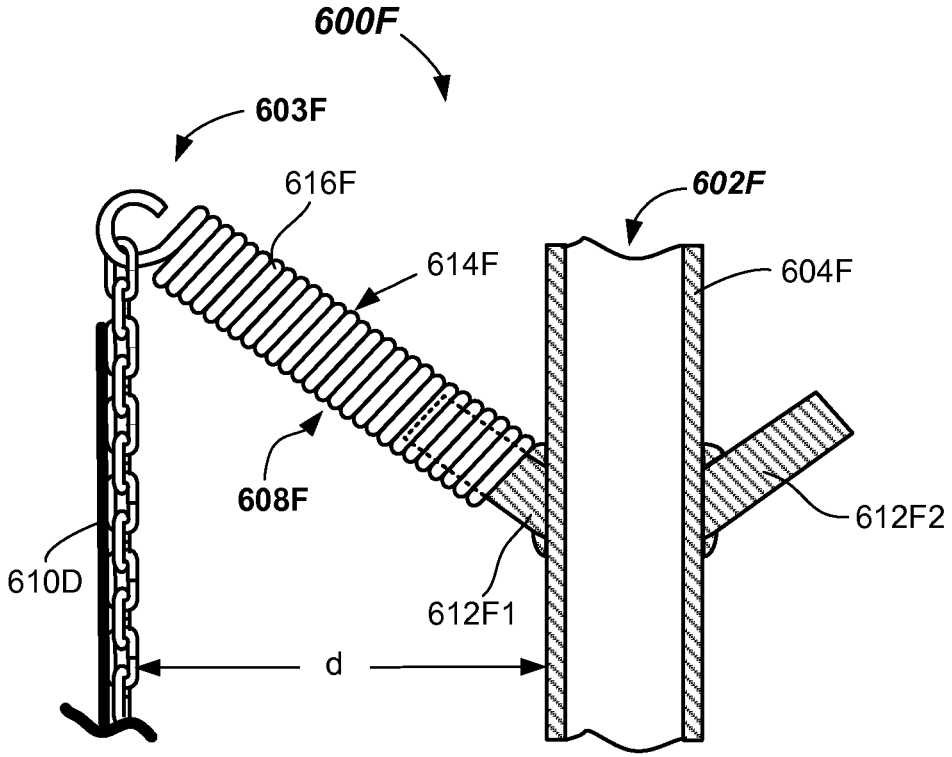
FIG. 6F illustrates a side view of yet another protective screen safety apparatus according to embodiments.
Figure 6G:
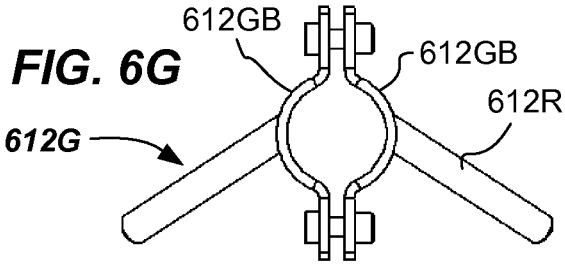
FIG. 6G illustrates a top view of an adapter for a protective screen safety apparatus according to embodiments.
Figure 6I:
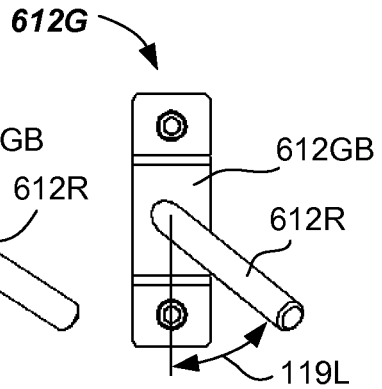
FIG. 6I illustrates another side view of the adapter of FIG. 6H according to embodiments.
Figure 6H:
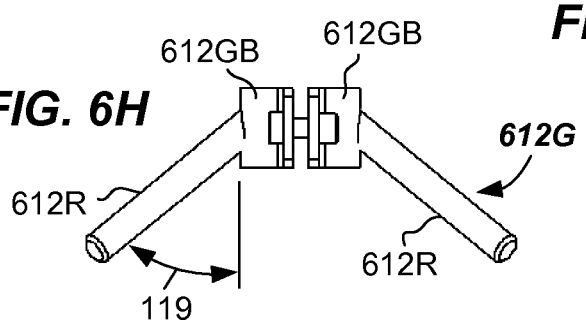
FIG. 6H illustrates a side view of the adapter of FIG. 6H according to embodiments.
Figure 6J:
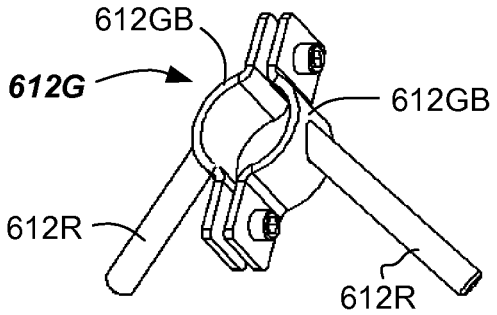
FIG. 6J illustrates a perspective view of the adapter of FIG. 6H according to embodiments.

FIG. 6F illustrates an additional embodiment of protective screen safety system 600F. In this embodiment, the extending attachment 614F of the protective screen safety apparatus 603F includes a coil spring as the spring member 616F. The inner diameter of the coil spring is inserted over the adapter 612F1, which may be a rod or tube coupled to the frame 604F of the protective screen 602F, such as by welding or other suitable means. This configuration suspends the safety net 610D a distance "d" as discussed above from the frame 604F of the protective screen 602F. This configuration is also reversible, by moving the extending attachments 614F to the other adapters 612F2.

FIGS. 6G-6J illustrates an alternate embodiment of an adapter 612G of a protective screen safety system. In this embodiment, the adapter 612G may be used to retro-fittingly couple (e.g., clamp via fasteners) to a protective screen frame 104 of a protective screen 102. The adapter 612G may include brackets 612 GB and a rod 612R coupled to each, such as by welding. Rod 612R may be hollow (e.g., a tube) in some embodiments. A coil spring, like the spring member 616F, may be received over the rod 612R in a like manner as is shown in FIG. 6F. This configuration also suspends the safety net a distance "d" as discussed above from the frame, but allows the adapter to be moved on the frame. This configuration is also reversible, by moving the extending attachment 614F to the other rod 612R. As should be apparent, the adapter 612G and thus the protective screen safety system to be retrofitted to a protective screen. The upward angle 119 to the vertical may be between about 10 degrees and about 80 degrees, between about 10 degrees and 60 degrees, between about 20 degrees and 50 degrees, and about 35 degrees in some embodiments. Lateral offset angle 119L may be between about 10 degrees and 60 degrees, or even between about 10 degrees and 50 degrees, between about 20 degrees and 40 degrees, and about 30 degrees in some embodiments. Length of rod 612R may be about 3 to 4 inches. Diameter of the rod may be sized slightly smaller than the inner diameter of the spring member 616F. Brackets 612 GB may be sized to fit any size of the protective screen frame 104.

Figure 7:
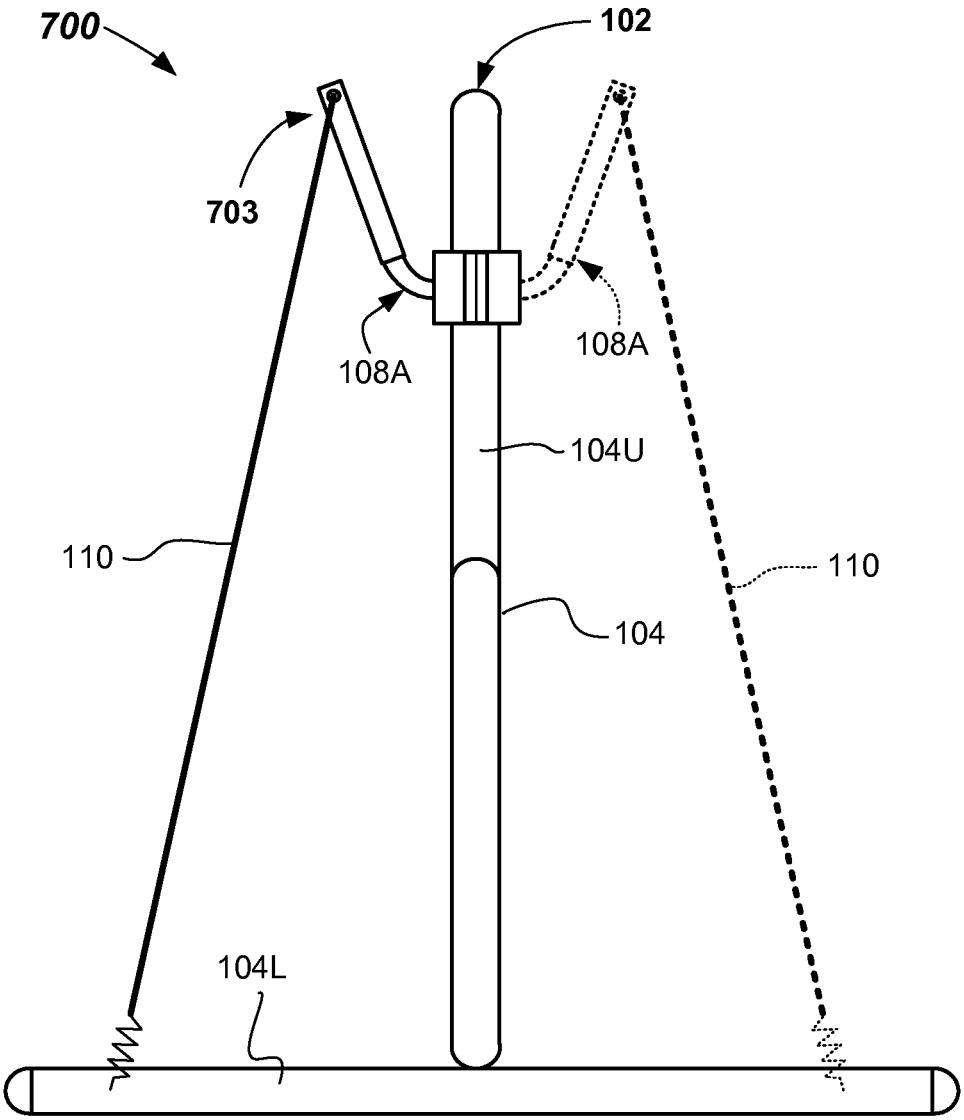
FIG. 7 illustrates a side view of an alternate protective screen system including a protective screen safety apparatus according to embodiments.

FIG. 7 illustrates another embodiment of the protective screen safety system 700. In this embodiment, the safety net 110 of the protective screen safety apparatus 703 may be attached to the top of the spacing connector 108A and also at the bottom of the safety net 110. For example, the bottom of the safety net 110 may be attached directly to the supports 104L of the protective screen frame 104.

The bottom connection to the supports 104L may be secured a further horizontal distance away from the main upright 104U in some embodiments to create an angle so that the ball may deflect away from the batter. In other embodiments, the bottom connection to the supports 104L may be secured at a same or closer distance to the main upright 104U.

This protective screen safety apparatus 703 may also be reconfigurable. The attachment to the supports 104L may be provided on the reverse side along with a receiving part of the spacing connector 108A, so that the safety net 110 may be moved and reconfigured on the reverse side of the protective screen frame 104 (as shown dotted). The bottom connection to the supports 104L may be a spring, a bungee cord, or the like. Other types of connections (rigid or spring-type) may be used.

Figure 8:
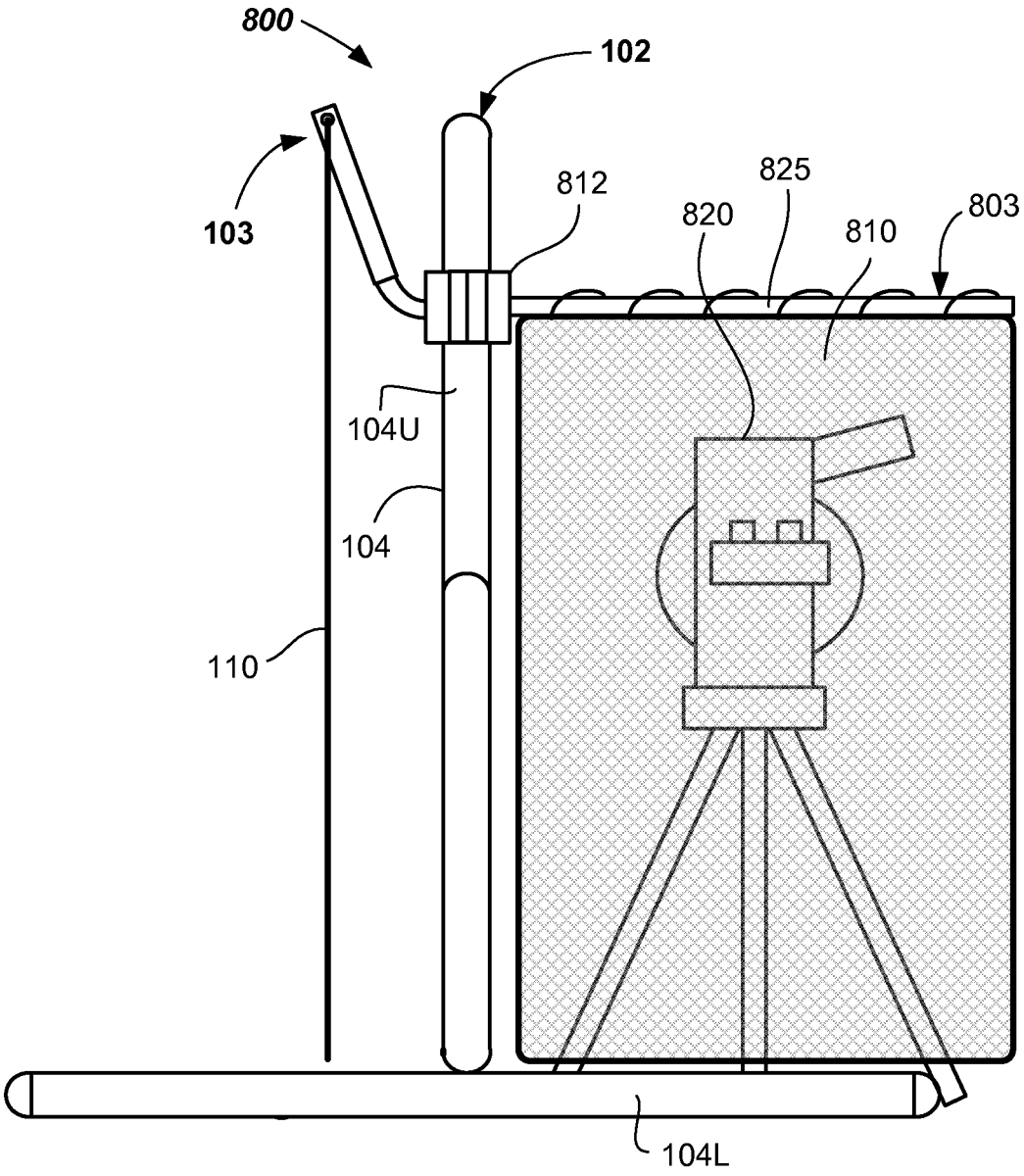
FIG. 8 illustrates a side view of an alternate protective screen system including a protective screen safety apparatus according to embodiments.

FIG. 8 illustrates another embodiment of the protective screen safety system 800. In this embodiment, a protective screen safety apparatus 103 as previously described in FIGS. 1 and 2 may be provided. In addition, a protective screen safety apparatus 803 may be provided. The safety net 810 in this embodiment is positioned (e.g., suspended) between a pitching machine 820 and the person throwing automated BP (e.g., the person feeding the pitching machine, who is being protected by the safety net 110 and the protective screen 102) on a side opposite the safety net 110.

The embodiment of the protective screen safety system 800 of FIG. 8 not only protects the batter from a ricocheting ball, but also the person feeding the pitching machine 820 from a ricochet from a batted ball off from the pitching machine 820. In the depicted embodiment, the adapter 812 may attach to the protective screen frame 104, and may have a recess that that receives a support rod 825. Support rod 825 may protrude substantially perpendicularly from the main upright 104U of the protective screen frame 104, for example. Angled configurations are also possible. Support rod 825 suspends a safety net 810 that is situated between the person feeding the pitching machine 820 and the pitching machine 820.

This safety net 810 may be made of any number of materials such as netting (described above), vinyl, rubber, and the like. The purpose is to provide the layer of protection from a ball ricocheting towards the person so that it will block any direct contact of the ball with the person, thus avoiding potential injury. Depending on the density of the material the safety net 810 is made of, the bottom end portion of the safety net 810 can be attached to a support 104L of the frame, another lower support rod, or the like. Thus, in some embodiments, the safety net 810 may be both secured at the top and the bottom to provide a tighter and less yielding surface for the ball to hit against. In an alternative embodiment, the support rod 825 may couple to its own adapter, like adapter 812. Using the protective screen safety apparatus 803 with the protective screen safety apparatus 103 offers protection for the person throwing automated BP, but also protection for the batter.

Figure 9:
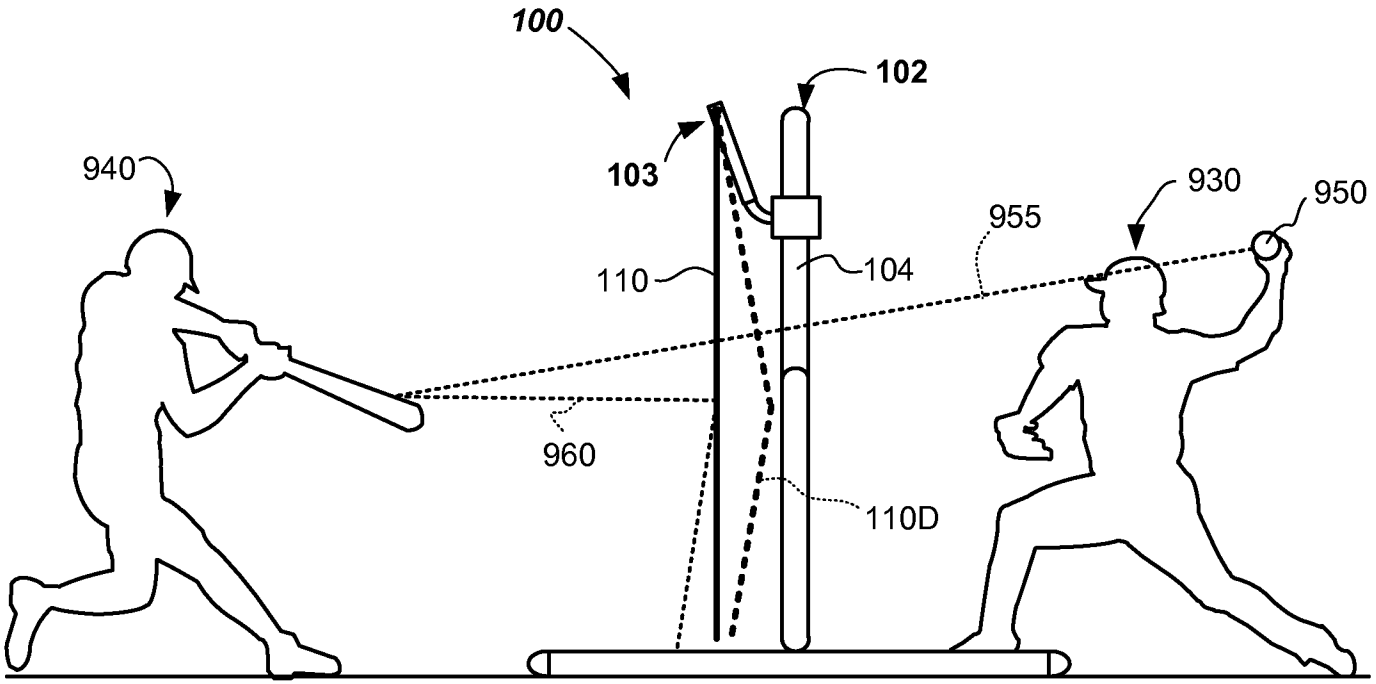
FIG. 9 illustrates a side view of a protective screen system including a protective screen safety apparatus in use according to embodiments.

FIG. 9 illustrates an embodiment of the protective screen system 100 in use. In this embodiment, a protective screen safety apparatus 103 as previously described in FIGS. 1 and 2 may be provided.

FIG. 9 shows an image of a BP between a person 930 throwing BP and a batter 940 using the protective screen system 100 including the protective screen safety apparatus 103 coupled to a protective screen frame 104 of a protective screen 102. The ball 950 being thrown by the person 930 proceeds along dotted path 955, is hit by the batter 940, and is directed towards the protective screen safety apparatus 103 along path 960. As the safety net 110 of the protective screen safety apparatus 103 is impacted by the batted ball 950, safety net 110 is deflected into a deflected condition 110D (shown dotted), and then may be safely redirected softly to the ground. Though the image shows a pitching throwing overhand, it may also be thrown underhand at even a closer distance, which is commonly called "front toss" BP. The protective screen safety apparatus 103 may offer suitable anti-bounce back protection for the batter 940 for this type of BP also. Furthermore, as discussed before, the protective screen safety apparatus 103 may offer enhanced protection for the person 930 throwing BP as well.

Figure 10:
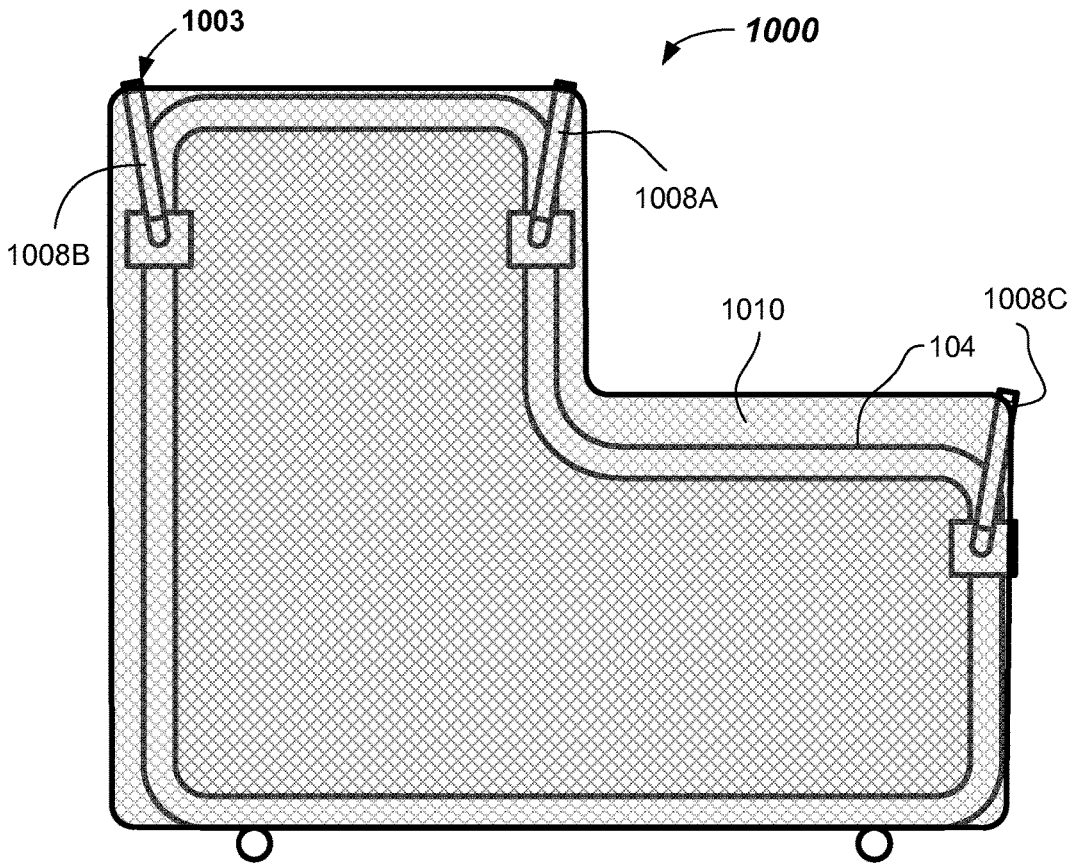
FIG. 10 illustrates a front view of a protective screen system including a protective screen safety apparatus according to embodiments.

FIG. 10 illustrates another embodiment of the protective screen system 1000. In this embodiment, a protective screen safety apparatus 1003 similar to that previously described in FIGS. 1 and 2 may be provided. However, in this embodiment, the safety net 1010 is positioned (e.g., suspended) in front of the main portion and also the lower portion of the protective screen frame 104. As such, the entire main outline of the protective screen frame 104 may be covered thereby. In this case, three spacing connectors 1008A-C, like described in any of the spacing connectors of FIGS. 1, 2, 3, 4A-4A, 6A-6J may be used.

Figure 11:
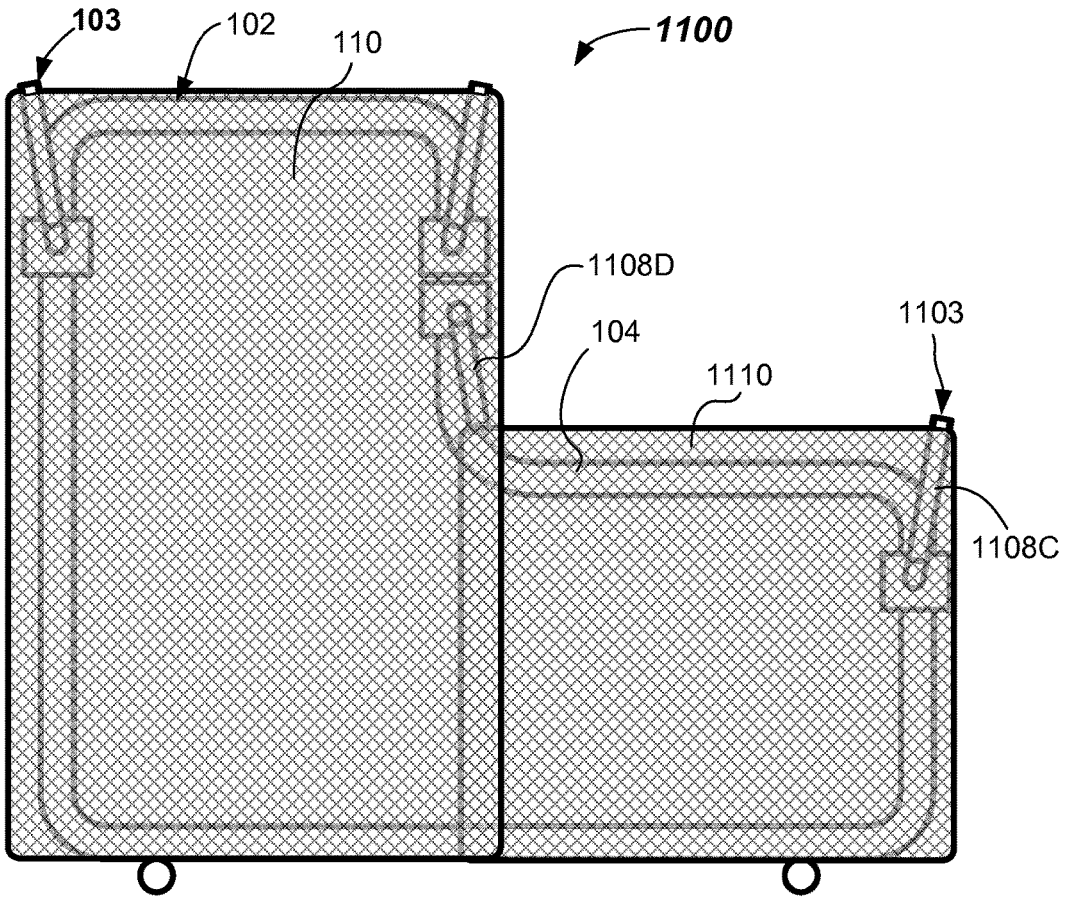
FIG. 11 illustrates a front view of a protective screen system including a protective screen safety apparatus including multiple safety nets according to embodiments.

FIG. 11 illustrates another embodiment of the protective screen system 1100. In this embodiment, a protective screen safety apparatus 103 as previously described in FIGS. 1 and 2 may include safety net 110 to prevent ricochet from a first main portion of the protective screen frame 104 of the protective screen 102. A second protective screen safety apparatus 1103 may provide a second safety net 1110 positioned (e.g., suspended) so that the lower portion of protective screen frame 104 is covered thereby. In this case, two additional spacing connectors 1108C and 1108D, like described in any of the spacing connectors may be used. The two safety nets 110, 1110 may be positioned to overlap, as shown.

Figure 12:
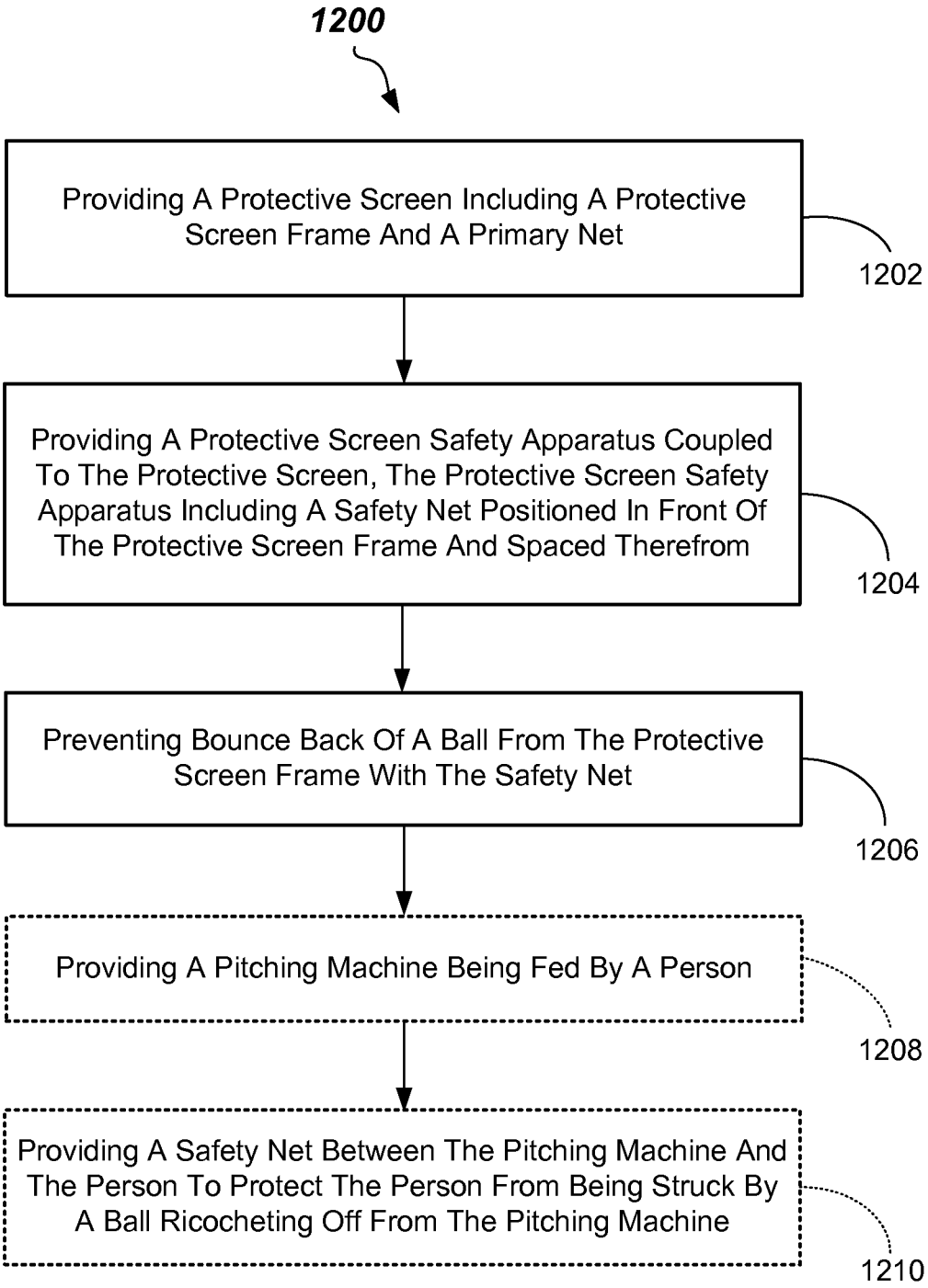
FIG. 12 illustrates a flowchart depicting a method of protecting a batter according to embodiments.

The flowchart shown in FIG. 12 illustrates a method 1200 of protecting a batter according to one or more embodiments. The method 1200 includes, in 1202, providing a protective screen including a protective screen frame and a primary net, and, in 1204, providing a protective screen safety apparatus coupled to the protective screen, the protective screen safety apparatus including a safety net positioned in front of the protective screen frame and spaced therefrom.

The method 1200 includes, in 1206, preventing bounce back of a ball from the protective screen frame with the safety net.

Optionally, the flowchart shown in FIG. 12 illustrates a method 1200 of additionally protecting a pitcher running a pitching machine according to one or more embodiments. The method 1200 optionally includes, in 1208, providing a pitching machine being fed by a person, and in 1210, providing a safety net between the pitching machine and the person to protect the person from being struck by a ball ricocheting off from the pitching machine.

Figure 13:
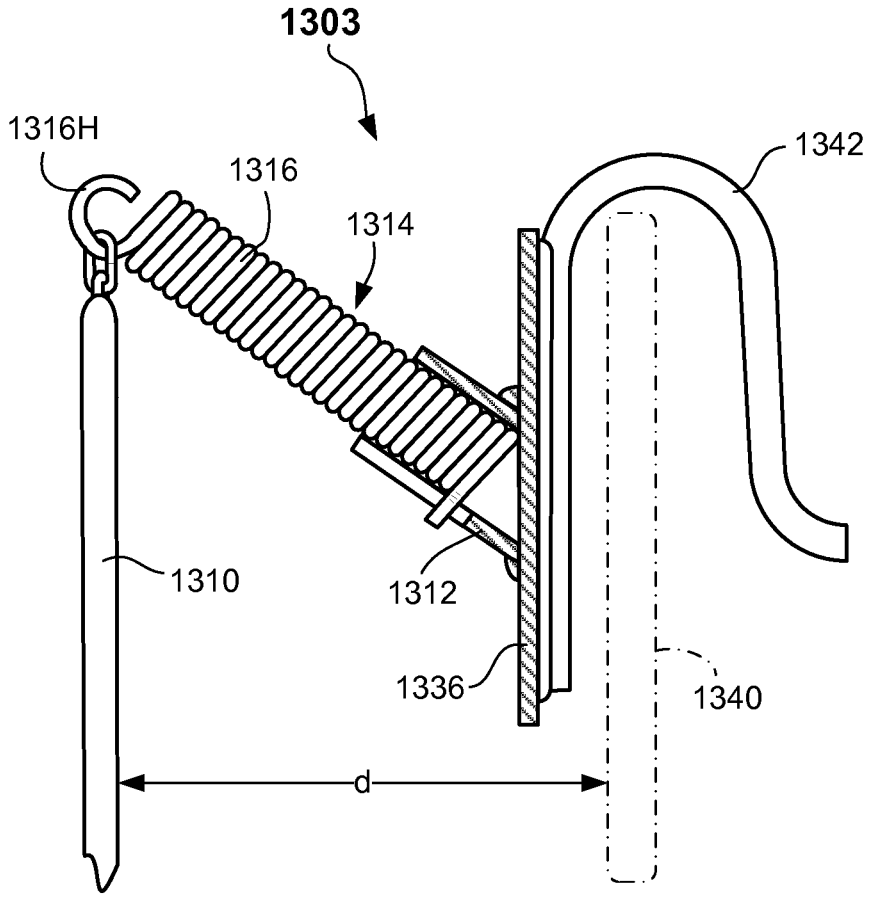
FIG. 13 illustrates a side view of a protective screen safety apparatus for use on, and protection of, a chain-link fence according to embodiments.
Figure 14:
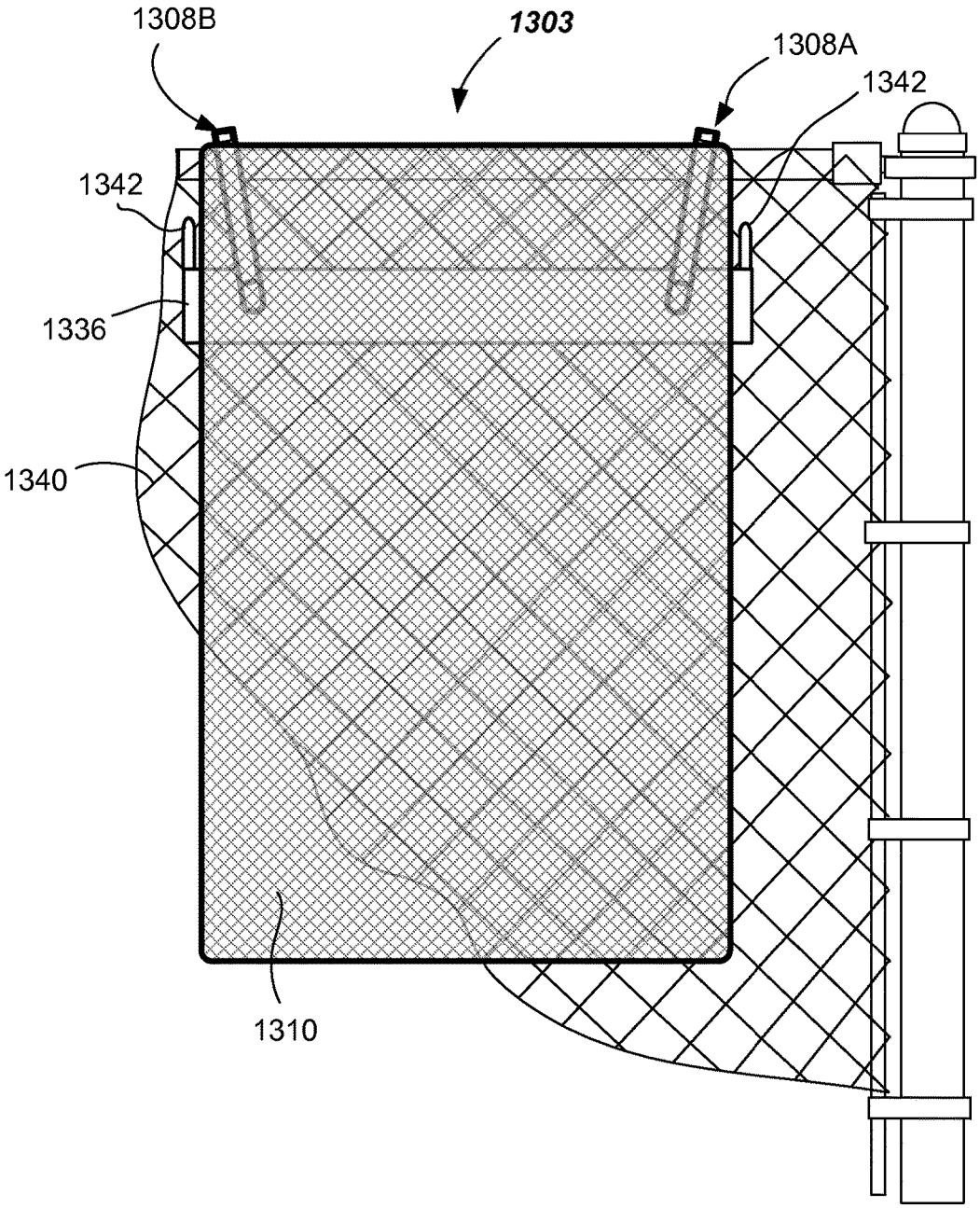
FIG. 14 illustrates a front view of a protective screen safety apparatus installed on a chain-link fence according to embodiments.

FIGS. 13 and 14 illustrates another embodiment of a protective screen safety apparatus 1303 configured and adapted to hang on, and provide protection for, a chain-link fence 1340. This embodiment of the protective screen safety apparatus 1303 includes an extending attachment 1314 comprising a spring member 1316, which may be a coil spring. Other types of spring members 1316 may be used. However, in this embodiment, the adapter 1312 may be welded to a support frame 1336 (e.g., a longitudinal frame). The support frame 1336 may include two spacing connectors 1308A, 1308B coupled thereto at spaced intervals thereon (FIG. 14). Connectors 1342 may be attached to the support frame 1336, such as by welding or mechanical fastening. As depicted, the connectors 1342 are U-shaped members. However, any suitable connection features for connecting the support frame 1336 of the protective screen safety apparatus 1303 to the structure of the chain-link fence 1340 may be used, such as straps, chains, clips, brackets, and the like. Like the other embodiments, the safety net 1310 may be secured to the hook 1316H so that the safety net 1310 may be spaced a lateral distance "d" from a chain-link fence 1340. "d may be the distance as described above. In the depicted embodiment, the safety net 1310 may be about 4 feet tall×3 feet wide, for example. Other sizes may be used. Also, in some embodiments, the frame 1336 may include two pieces, with one spacing connector 1308A coupled to a first frame part, and the other spacing connector 1308B coupled to a second frame part, where each frame part is attached to the chain-link fence 1340 separately. In each case, the safety net may be suspended from hooks 1316H on the spacing connectors 1308A, 1308B.

Figure 15A:
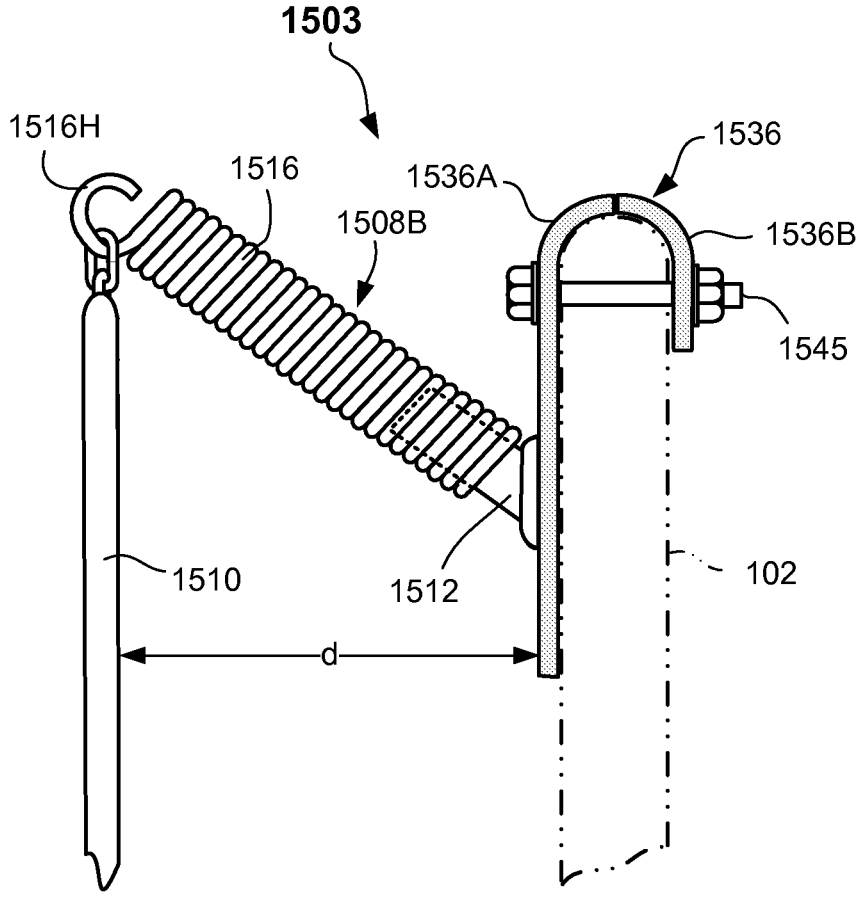
FIG. 15A illustrates a partial side view of a protective screen safety apparatus installed on a protective screen according to embodiments.

As shown in FIG. 15A, another embodiment of a protective screen safety apparatus 1503 is shown. Protective screen safety apparatus 1503 includes a support frame 1536 that is adapted to be coupled to a protective screen 102 (shown dotted) by connection features, spacing connectors 1508A, 1508B coupled to the support frame 1536, and a safety net 1510 connected and supportable by hooks 1516H on the spacing connectors 1508A, 1508B. The spacing connectors 1508A, 1508B and support frame 1536 may be configured, so that in use (as coupled to the protective screen 102) the safety net 1510 is positioned adjacent to the frame 1536, but is spaced laterally therefrom by the distance "d" as shown. Distance "d" may be as described above. The protective screen safety apparatus 1503 is configured and adapted to prevent damaging contact of a struck ball with the protective screen 102. As in the previous embodiments, a spring member 1516 (e.g., a coil spring) may couple to an adapter 1512. Other types of adapters 1512 and spring members 1516 may be used.

Figure 15B:
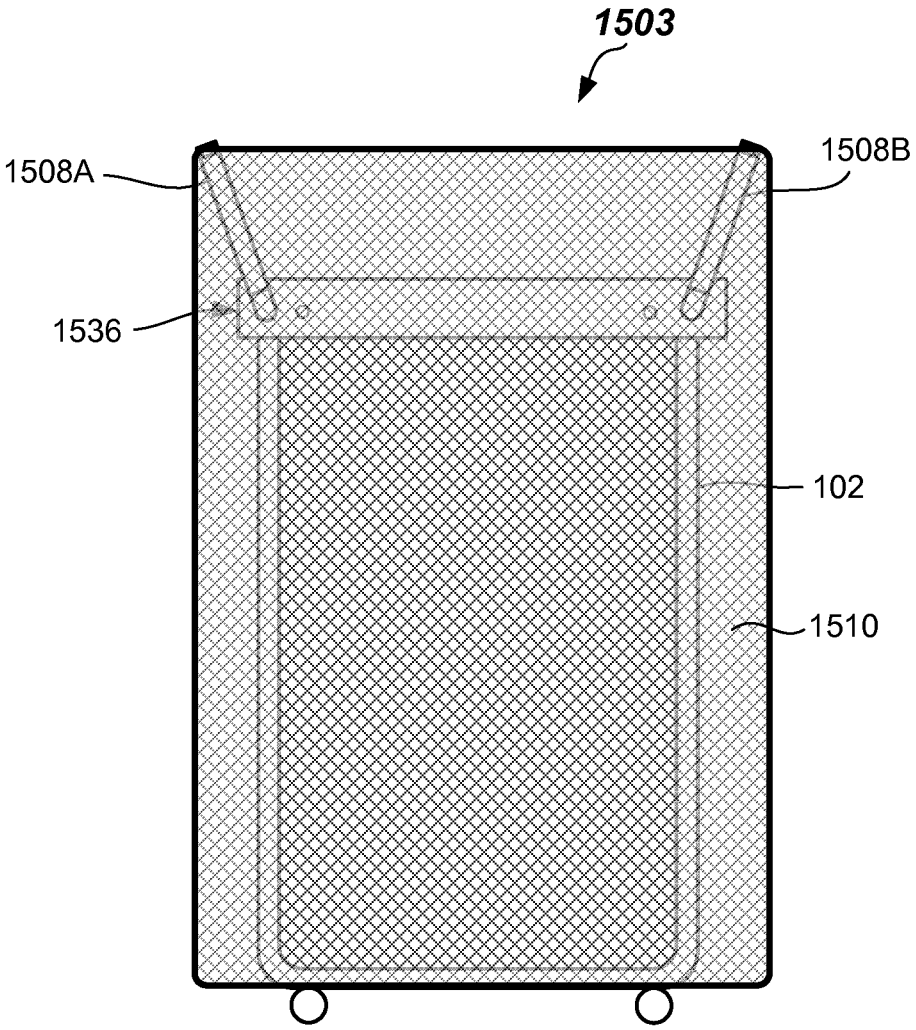
FIG. 15B illustrates a front view of a protective screen safety apparatus installed on a protective screen according to embodiments.

In more detail, the support frame 1536 may be a one-piece or multi-piece member that may be hung on, suspended on, clamped on, or bolted to the protective screen 102 as a connection feature. This embodiment of protective screen safety apparatus 1503 may be retrofitted to an existing protective screen 102, by coupling the protective screen safety apparatus 1503 to an upper portion of the protective screen 102 as is shown in FIG. 15B. In this embodiment, the support frame 1536 may include a first piece 1536A and a second piece 1536B, which cooperate with one another to secure the protective screen safety apparatus 1503 to the protective screen 102. In this embodiment, one or more fasteners 1545 may secure the first piece 1536A to the second piece 1536B.

Figure 16:
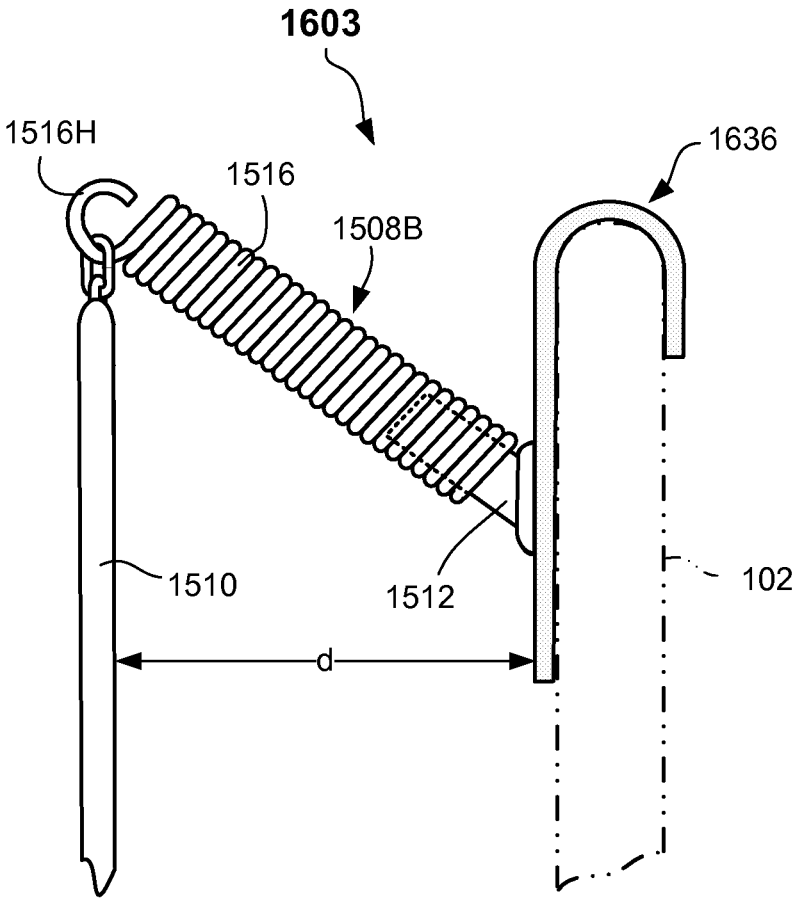
FIG. 16 illustrates a partial side view of a protective screen safety apparatus installed on a protective screen according to one or more embodiments.
Figure 17A:
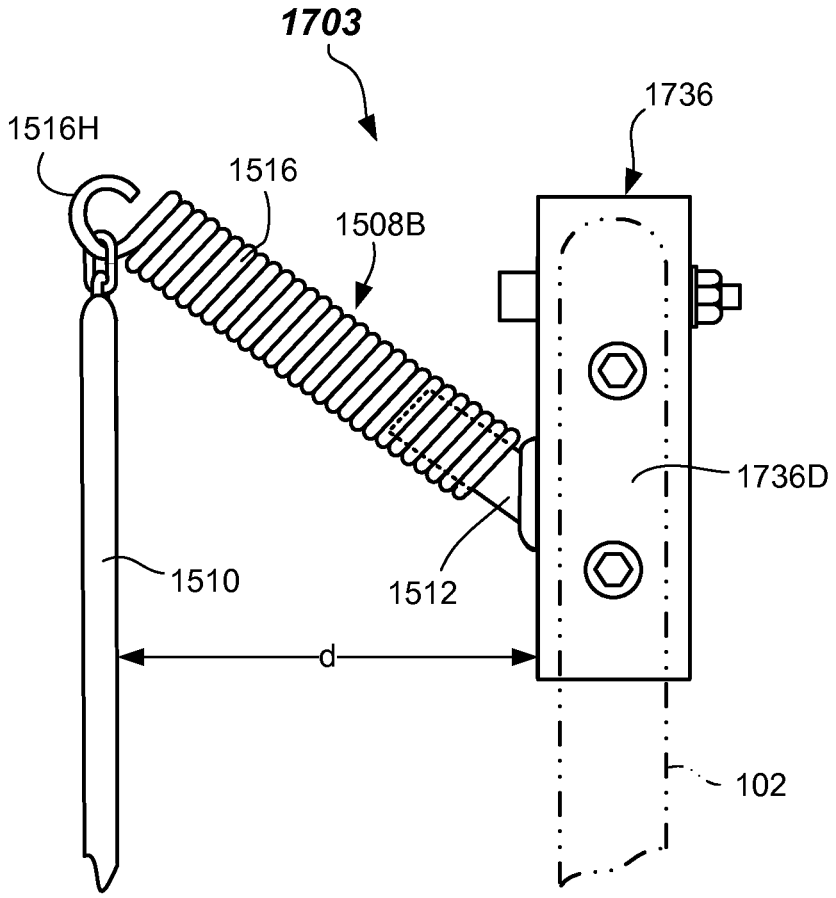
FIG. 17A illustrates a partial side view of a protective screen safety apparatus installed on a protective screen according to one or more embodiments.
Figure 17F:
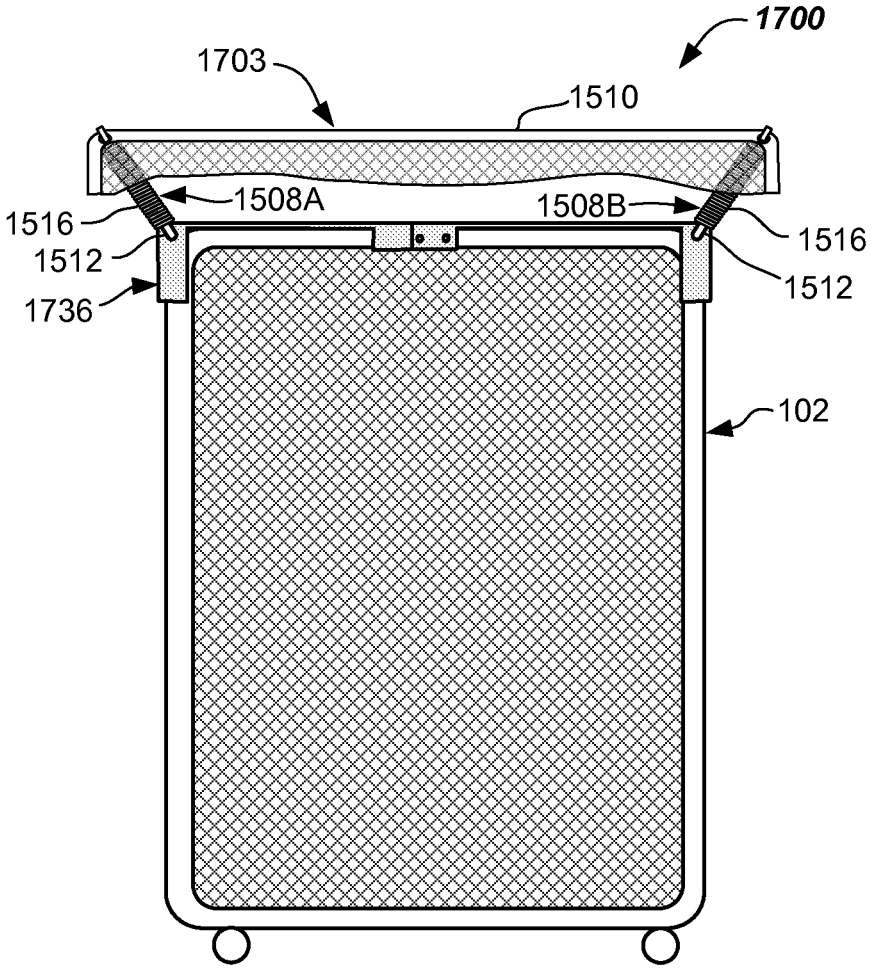
FIG. 17F illustrates a partial front view of a protective screen safety apparatus installed on a protective screen according to one or more embodiments.

However, in some embodiments, such as shown in FIG. 16, the support frame 1636 may be made of a one-piece construction including a bent top as a connection feature and the support frame 1636 may simply be hung onto the upper portion of the protective screen 102, as shown. Optionally, end caps may be welded to the left and right ends of the support frame 1636 to help laterally position the support frame 1636 on the protective screen 102 and prevent the frame from sliding laterally sideways on the protective screen 102.

FIGS. 17A-17F illustrates a protective screen system 1700 including another embodiment of a protective screen safety apparatus 1703. Protective screen safety apparatus 1703 includes a support frame 1736 that is adapted to be adjustably coupled to a protective screen 102 (shown dotted) by connection features, spacing connectors 1508A, 1508B coupled to the support frame 1736, and a safety net 1510 supported by the spacing connectors 1508A, 1508B. The spacing connectors 1508A, 1508B and support frame 1736 may be configured, so that in use (as coupled to the protective screen 102) the safety net 1510 is positioned adjacent to and in front of the support frame 1736, but is spaced laterally therefrom by a distance "d" as shown. Distance "d" may be as described above herein.

In more detail, the support frame 1736 is a multi-piece, adjustable frame including first through fourth frame pieces 1736A, 1736B, 1736C and 1736D. First frame piece 1736A (FIG. 17B) and second frame piece 1736B (FIG. 17C) may be rigid bent material pieces (e.g., metal such as steel or aluminum) that include interfacing ends 1746A, 1746B that are moveable (e.g., laterally) relative to one another, but may also be lockable to one another so that the first frame piece 1736A (FIG. 17B) and second frame piece 1736B can be adjusted in width to fit any number of widths of protective screen 102 and locked in place. Third and fourth frame pieces 1736C, 1736D are end pieces that couple to first and second end portions 1748A, 1748B of the first frame piece 1736A (FIG. 17B) and second frame piece 1736B (FIG. 17C) to capture the frame of the protective screen 102. Thus, third and fourth frame pieces 1736C, 1736D cooperate with the first and second end portions 1748A, 1748B to provide connection features to capture and connect to the frame of the protective screen 102 and provide adjustment capability for a multitude of different frame sizes and widths.

Interfacing ends 1746A, 1746B may comprise combinations of holes and/or slots that allow securing of the first frame piece 1736A to the second frame piece 1736B and allow adjustment to a desired frame width by one or more fasteners. In some embodiments slots may be provided in each of the interfacing ends 1746A, 1746B to allow additional adjustment. Other suitable means for securing the interfacing ends 1746A, 1746B to each other, with or without width adjustment capability, may be used. The third and fourth frame pieces 1736C, 1736D may be fastened to the first and second end portions 1748A, 1748B, respectively, by one or more fasteners received in combinations of holes and/or slots that allow securing the third frame piece 1736C to the first end portion 1748A and the fourth frame piece 1736C to the second end portion 1748B at a desired frame thickness.

Once the support frame 1736 is properly fitted and secured to the protective screen 102, the spring members 1516 may be inserted over the adapters 1512 to form the spacing connectors 1508A, 1508B upon which the safety net 1510 (safety net 1510 shown cut/truncated for clarity) may be attached, such as on hooks 1516H.

In each of the above-described protective screen safety apparatus 1503, 1603, 1703, the safety net 1510 may include any of the constructions described herein. Likewise, the spacing connectors 1508A, 1508B may include any of the constructions described herein. Specifically shown in FIG. 15A-17F are spacing connectors 1508A, 1508B comprising coil springs as the spring member 1516, which may have a hook 1516H formed thereon as an attachment feature configured to attach the safety net 1510 to the spacing connectors 1508A, 1508B. The depicted embodiment may include any form of adapter 1512 for attaching the extending attachment to the frame 1536, 1636, 1736. As shown, the adapter 1512 may be a post or tube welded to the frame 1536, 1636, 1736. The post may be welded in the compound-angled configuration as described herein (see FIGS. 6H-6I).

Figure 18A:
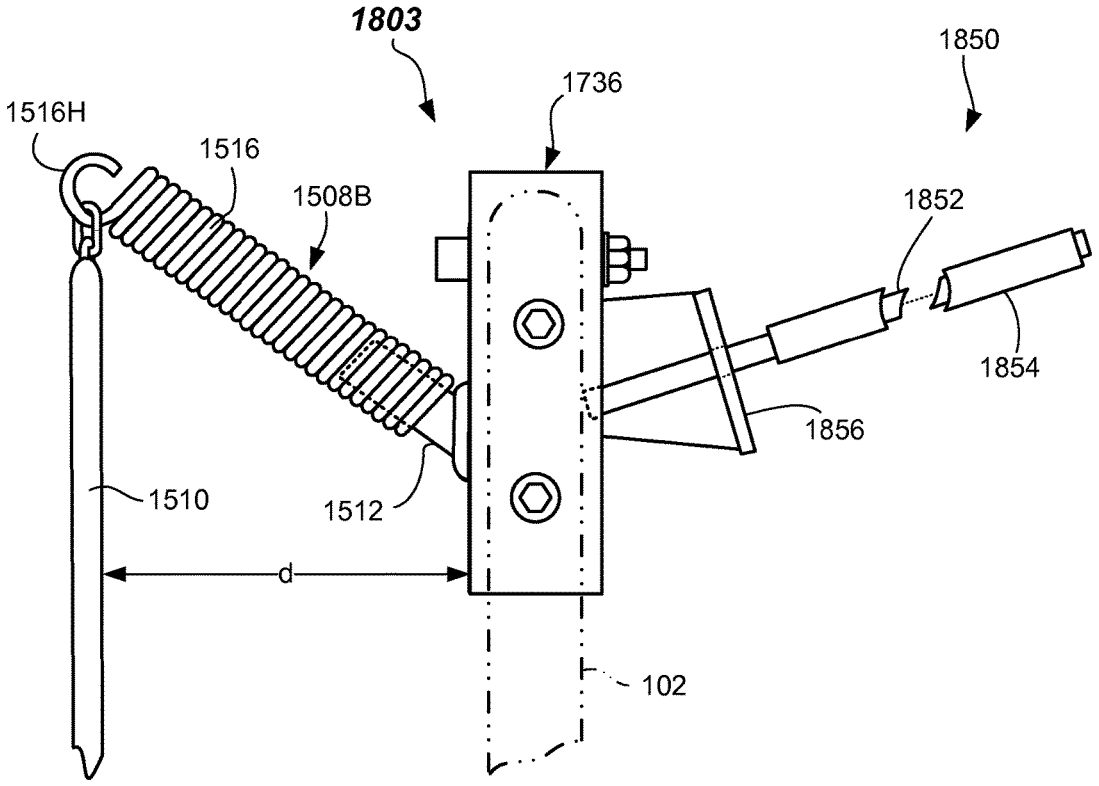
FIGS. 18A and 18B illustrate a side and rear views, respectively, of a protective screen safety apparatus including a head safety assembly according to one or more embodiments.
Figure 18B:
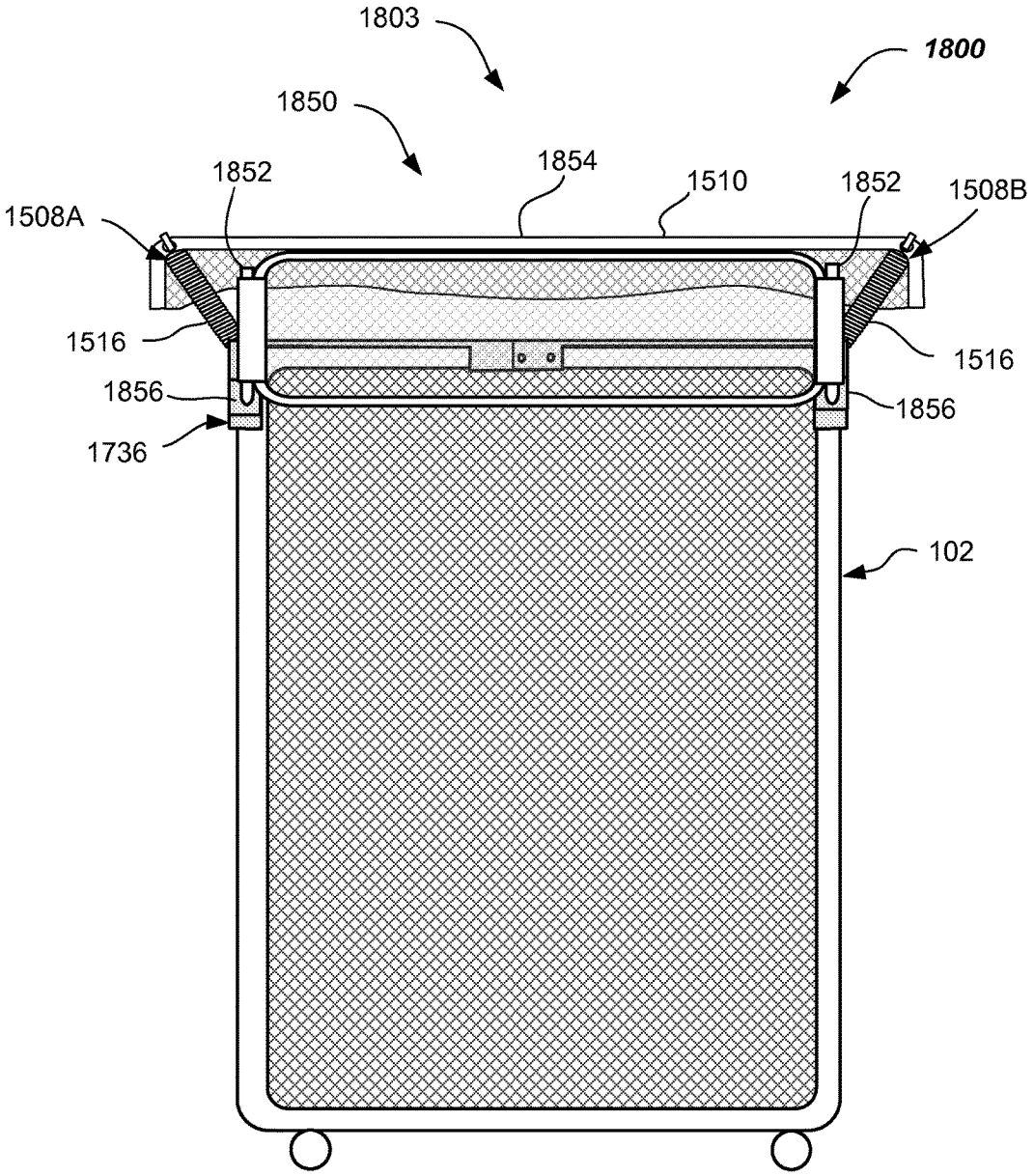

FIGS. 18A and 18B illustrates another embodiment of protective screen system 1800 including a protective screen safety apparatus 1803. This embodiment is the same as the embodiment of FIG. 17A-17F except that the protective screen safety apparatus 1803 includes a head safety assembly 1850. Head safety assembly 1850 includes head net supports 1852 coupled to the frame 1736, and a head net 1854 coupled to the heat net supports 1852. The protective screen safety apparatus 1803 allows for batter protection from bounce back and also protects the head of the person throwing BP. The head net 1850 may be of the same construction for the other nests described herein, and may be between about 1 feet to about 4 feet long, or about 2½ feet and 3½ feet in some embodiments and approximately the width of the protective screen 102. The head net 1854 could be lighter (e.g., #21 net) because the ball doesn't hit at high speed thereon. The head supports 1852 may be rods of metal, fiberglass, plastic, or the like. Fiberglass rods of approximately ¾ inch diameter may be used. Head net supports 1852 may be the length of the head net 1854 described above. Head net supports 1852 may be fastened to the frame 1736 by any suitable means, such as sitting in a pocket, welding, mechanical fastening, or the like. In the depicted embodiment, the head net supports 1852 may be received through holes in support brackets 1856 and supported in a hole in the frame 1736.

The heat net 1854 and head supports 1852 may be angled at an angle between about 5 degrees and 30 degrees, or between about 10 degrees and 25 degrees, from the horizontal, for example. Other angles may be used. The highest part of the head net 1854 should not extend above the top of the safety net 1510. The head net 1854 may be fastened to the head net supports by any suitable means, such as lacing, typing, hooking, or the like. In some embodiments, the head net 1854 may include a border and may include sewn sleeves on each lateral side of the head net 1854 that may be slid over the head net supports 1852. In operation, the head safety assembly 1850 may prevent balls from dropping on the head or body of the person throwing BP.

While embodiments of the invention are susceptible to various modifications and alternative forms, specific apparatus and system embodiments and methods thereof have been shown by way of example in the drawings and are described in detail herein. It should be understood, however, that it is not intended to limit the invention to the particular apparatus, systems, or methods disclosed, but, to the contrary, the intention is to cover all modifications, equivalents, and alternatives falling within the scope of the invention.

The invention claimed is:

1. A protective screen system, comprising:

a protective screen including a protective screen frame having a horizontal member and upright members and a primary net coupled to the protective screen frame; and a protective screen safety apparatus coupled to the protective screen frame at preselected locations, the protective screen safety apparatus including:

one or more spacing connectors, wherein each of the one or more spacing connectors comprise:

an adapter coupled to and extending outwardly from the protective screen frame at one location of the preselected locations; and a spring member including a first end and a second end, the first end of the spring member being either inserted in the adapter or inserted over the adapter, and wherein the spring member extends outwardly from the adapter, and a safety net supported and suspended at the second end of the spring member in front of and spaced away from the horizontal member and upright members such that the safety net hangs slightly wider than the horizontal member and upright members, and is spaced a sufficient distance in front of the preselected locations to prevent a ball from ricocheting off from the horizontal member and upright members of the protective screen frame.

2. The protective screen system of claim 1, wherein at least some of the one or more spacing connectors comprise:

the adapter configured to clamp to the protective screen frame; and an extending attachment comprising the spring member from which the safety net is suspended.

3. The protective screen system of claim 1, wherein the spring member has a vertical spring rate of between 0.5 lb/in and 5 lb/in.

4. The protective screen system of claim 1, wherein the spring member protrudes at an angle between 10 degrees to 80 degrees from a horizontal.

5. The protective screen system of claim 1, wherein the one or more spacing connectors supports the safety net at the distance in front of the protective screen frame of about 3 inch or more.

6. The protective screen system of claim 1, wherein the one or more spacing connectors supports the safety net at a distance in front of the protective screen frame of between 3 inch to 20 inch.

7. A protective screen system, comprising:

a protective screen including a protective screen frame having a horizontal member and upright members and a primary net coupled to the protective screen frame; and a protective screen safety apparatus coupled at laterally-spaced locations to the protective screen frame, the protective screen safety apparatus including:

a first spacing connector including a first adapter extending outwardly from a first one of the laterally-spaced locations and a first spring member, the first spring member further including a first end and a second end, the first end coupled to the first adapter and the second end extending outwardly and upwardly relative to the first end, a second spacing connector including a second adapter extending outwardly from a second one of the laterally-spaced locations and a second spring member, the second spring member further including a first end and a second end, the first end of the second spring member coupled to the second adapter and a second end of the second spring member extending outwardly and upwardly relative to the first end of the second spring member, a safety net coupled to the second end of the first spring and coupled to the second end of the second spring and suspended in front of the horizontal member and upright members, wherein the safety net hangs slightly wider than the horizontal member and upright members and is spaced a sufficient distance in front of the horizontal member and upright members to prevent a ball from ricocheting off from the horizontal member and upright members.

* * * * *